US007506778B2

(12) United States Patent
DaSilva et al.

(10) Patent No.: US 7,506,778 B2
(45) Date of Patent: Mar. 24, 2009

(54) MODULAR PACKAGING SYSTEM

(75) Inventors: Robert A. DaSilva, Lowell, MA (US); Jerome P. Fanucci, Lexington, MA (US)

(73) Assignee: Kazak Composities, Incorporated, Woburn, MA (US)

( * ) Notice: Subject to any disclaimer, the term of this patent is extended or adjusted under 35 U.S.C. 154(b) by 665 days.

(21) Appl. No.: 11/032,570

(22) Filed: Jan. 10, 2005

(65) Prior Publication Data

US 2005/0161452 A1 Jul. 28, 2005

Related U.S. Application Data

(60) Provisional application No. 60/535,661, filed on Jan. 9, 2004.

(51) Int. Cl.
*B65D 21/02* (2006.01)
*B65D 45/28* (2006.01)
*B65D 45/16* (2006.01)

(52) U.S. Cl. ..... 220/23.4; 220/23.83; 220/323; 220/324

(58) Field of Classification Search ..... 220/23.4, 220/23.6, 318, 323, 324, 378, 23.83
See application file for complete search history.

(56) References Cited

U.S. PATENT DOCUMENTS

| | | | | | |
|---|---|---|---|---|---|
| 3,176,880 | A * | 4/1965 | Archbold | ..... | 222/158 |
| 4,024,983 | A * | 5/1977 | Muehl | ..... | 220/316 |
| 4,077,840 | A * | 3/1978 | Aubert | ..... | 376/463 |
| 4,542,930 | A * | 9/1985 | Adams | ..... | 294/160 |
| 4,782,945 | A * | 11/1988 | Geiler et al. | ..... | 206/203 |
| 5,255,815 | A * | 10/1993 | Renk et al. | ..... | 220/323 |
| 5,381,916 | A * | 1/1995 | Strawder | ..... | 220/23.4 |
| 6,047,827 | A * | 4/2000 | Huang | ..... | 206/379 |
| 6,296,541 | B1 * | 10/2001 | Bezalel et al. | ..... | 446/105 |

* cited by examiner

*Primary Examiner*—Anthony D Stashick
*Assistant Examiner*—Niki M Eloshway
(74) *Attorney, Agent, or Firm*—Weingarten, Schurgin, Gagnebin & Lebovici LLP

(57) ABSTRACT

A modular packaging system of containers each having a generally tubular, hollow container body of a fiber-reinforced composite material with cooperative mating interlocking elements extending axially along its length. The interlocking elements allow the containers to be stacked and palletized in a stable manner. An interface between a closure mechanism and the container body provides a good seal and prevents fraying or brooming of the fiber-reinforced composite material at the end face of the body.

12 Claims, 23 Drawing Sheets

FIG. 10C
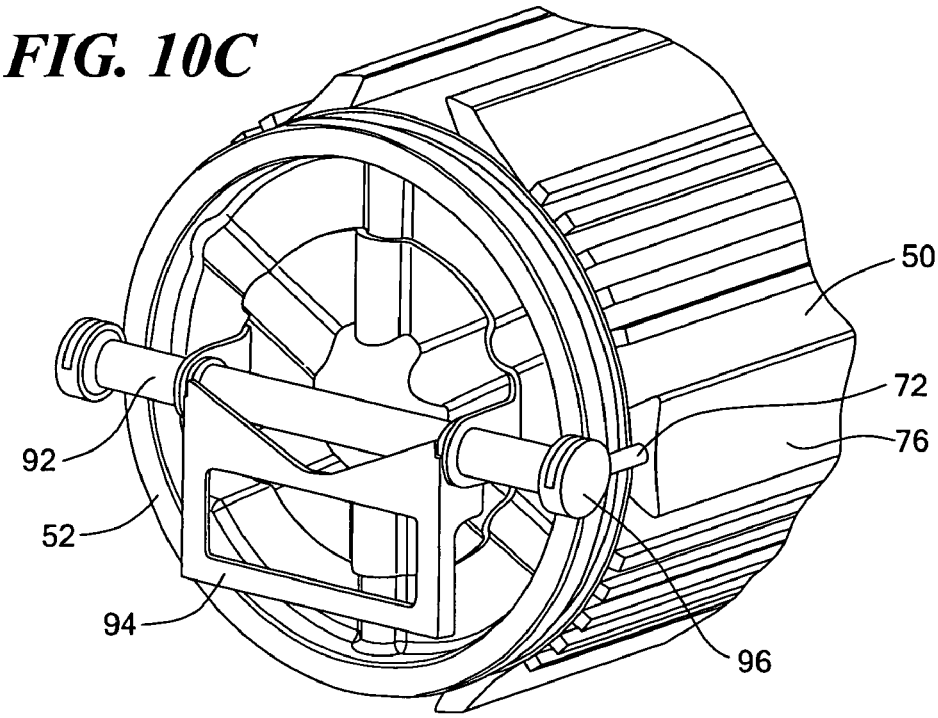
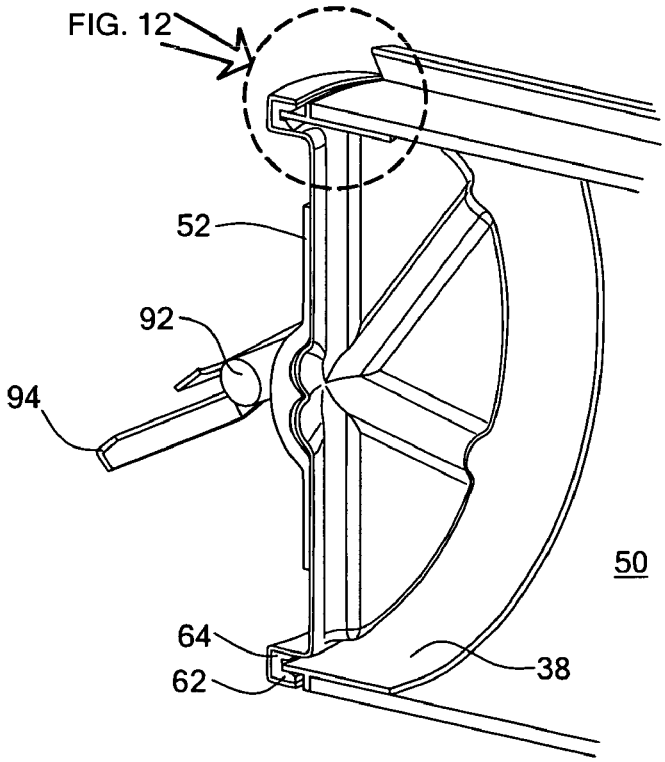
FIG. 11

MODULAR PACKAGING SYSTEM

CROSS REFERENCE TO RELATED APPLICATIONS

This application claims the benefit under 35 U.S.C. § 119 (e) of U.S. Provisional Application No. 60/535,661, filed on Jan. 9, 2004, the disclosure of which is incorporated by reference herein.

STATEMENT REGARDING FEDERALLY SPONSORED RESEARCH OR DEVELOPMENT

This invention was made with Government support under Contract No. N000 14-03-M-0315 and Contract No. DAAE30-03-C-1041. The Government may have certain rights in this invention.

BACKGROUND OF THE INVENTION

Items often need to be packaged for shipment. Typically, items are placed in containers or boxes, and the containers are stacked on a pallet. The containers are tied down with straps to prevent the containers from moving during shipping. Round containers in particular are difficult to stack on pallets.

For certain applications, such as shipping explosive items, the containers must maintain a seal against air and liquids and must be preloaded to contain a minimum pressure within the container. Typically, metal containers are used for this purpose, because these requirements are more readily achieved with metals. Composite materials have generally not been used, because the seal between the end of the container and the closure is more prone to failure, such as from brooming or fraying of the fiber reinforcement of the composite material.

SUMMARY OF THE INVENTION

The present invention provides a packaging system having containers of a composite material capable of being readily arranged in a stable stack, such as on a pallet, and having an improved interface between the container body and a closure mechanism.

More particularly, the packaging system includes containers each having a container body extending axially from a first end to a second end. The container body has a constant cross-section along its axial length, which allows the container body to be readily manufactured via a pultrusion process from a fiber-reinforced composite material. Cooperative interlocking elements extend axially along an outer surface of the container body for interlocking with an adjacent container body, thereby allowing a plurality of container bodies to be arranged in a stable stack.

A closure member, which may be of a metal or a composite material, is configured to close one or both of the first and second ends of the container body. An interface between the closure member and the container body provides a good seal and prevents brooming or fraying of the fiber reinforced composite material of the container body.

The modular packaging system of the present invention is a low-cost, lightweight, easily disposable, and impact resilient system. Being low in weight, handling is easier and faster and costs of transport of loaded packaging are reduced. Simplification of interlocking and captivating features allows quick assembly and disassembly of the containers, which increases the speed of supply delivery. The system provides versatility in package contents and capacity and can be adapted to the needs and conditions of a variety of users.

The interlocking features provide a stable palletized structure under vibration and impact conditions. The packaging system improves palletization, the loading onto pallets, and minimizes or eliminates the need for banding to hold the modules together on the pallet.

DESCRIPTION OF THE DRAWINGS

The invention will be more fully understood from the following detailed description taken in conjunction with the accompanying drawings in which:

FIG. 10C is an isometric view of the end cap latched on the container body of the container of FIG. 9;

FIG. 11 is a cutaway view of the end cap, interface, and container body of FIG. 9;

DETAILED DESCRIPTION OF THE INVENTION

Figure 1:
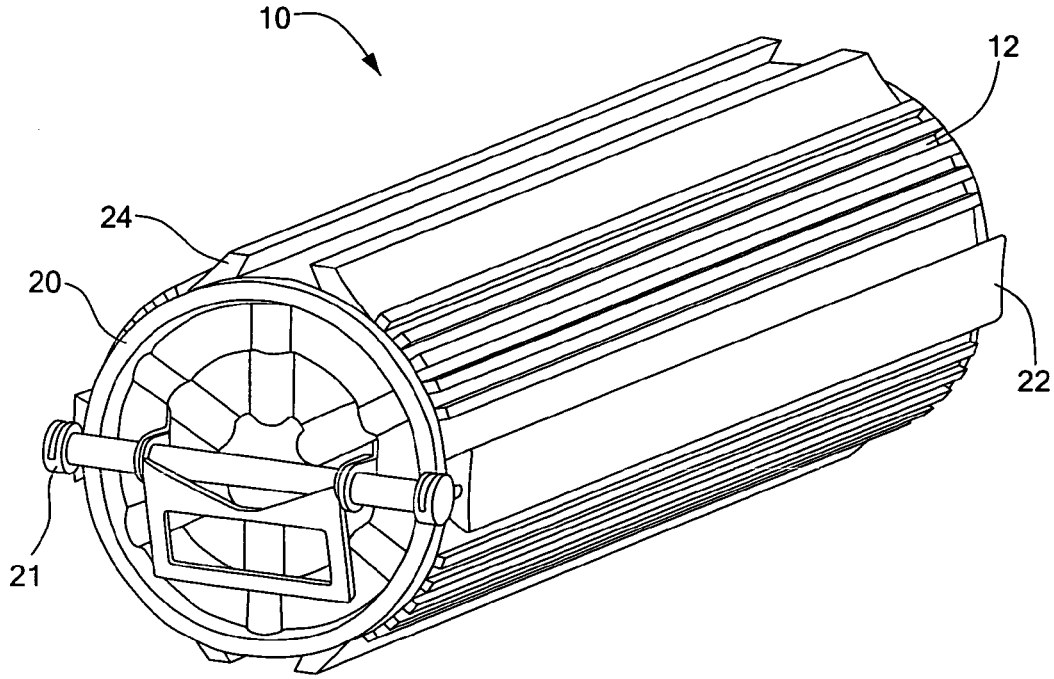
FIG. 1 is an isometric view of a container of the modular packaging system of the present invention.

In a first embodiment of the packing system of the present invention, a generally tubular container 10 is provided. See FIGS. 1-4. The container can have any suitable cross-section, such as round or rectangular. The tubular container is formed from an elongated hollow container body 12 having an interior surface 14 and open ends 16, 18. See FIG. 3. The ends of the container body are closed by closure members 20, described further below. Interlocking elements 22, 24 extend axially along the length of the outer surface of the container body. The interlocking elements allow multiple container bodies to be attached together along their lengths so that they can be readily arranged horizontally and vertically in a stack. See FIG. 2.

A dovetail type interlocking assembly is illustrated in FIGS. 1-4. At least one wedge-shaped part or tenon 22 extends axially along the length of the container body. The tenon fits within a corresponding recess or mortise 26 formed from a raised element 24 that extends axially along the length of the container body. Preferably, the mortise and tenon dovetail elements are provided in diametrically opposed pairs, although any desired configuration of interlocking elements can be provided. Similarly, other interlocking configurations can be provided. Stiffening ribs 28 can also be provided along the length of the container body.

Figure 2:
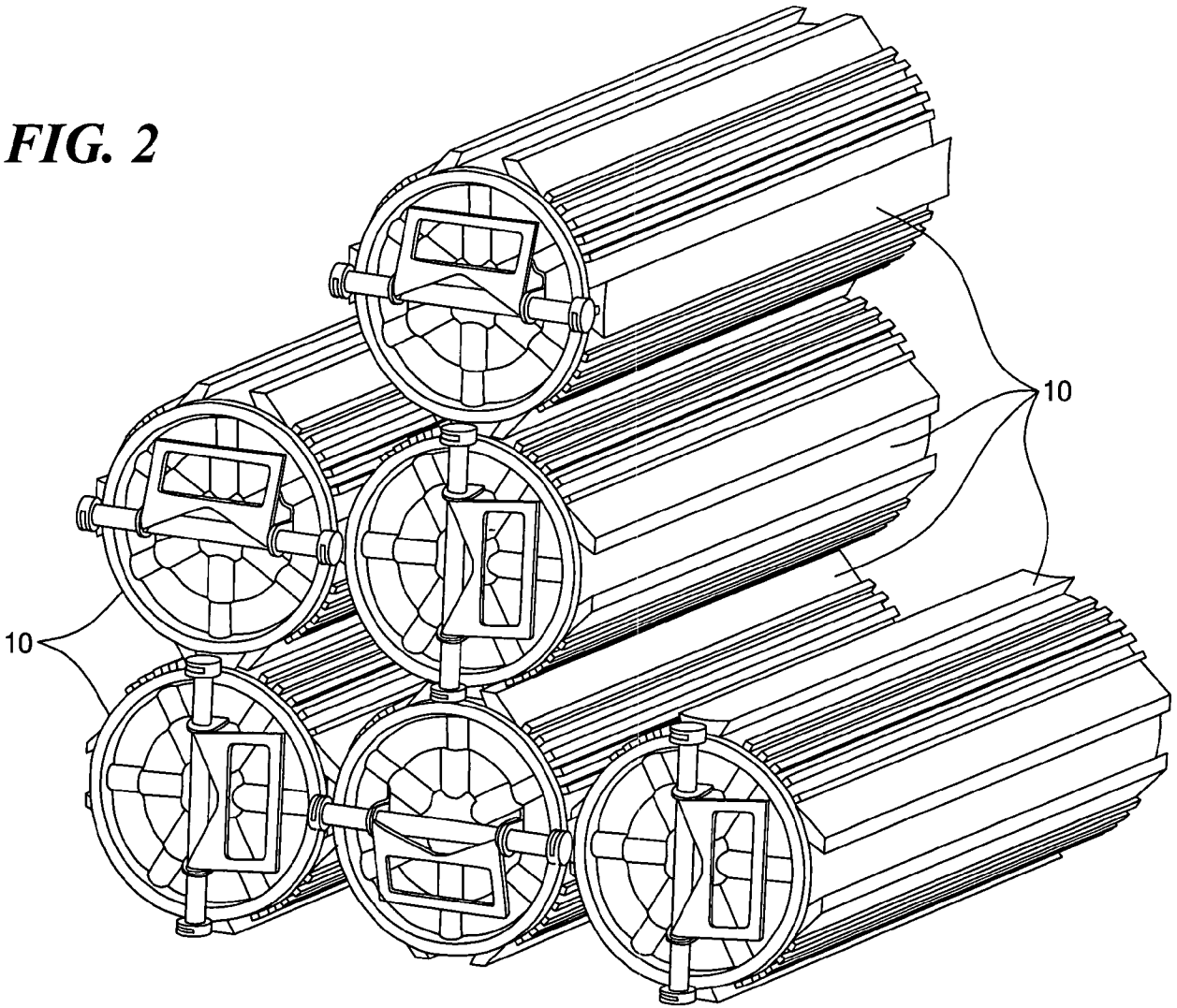
FIG. 2 is an isometric view of a plurality of containers of FIG. 1 arranged in a stack.
Figure 3:
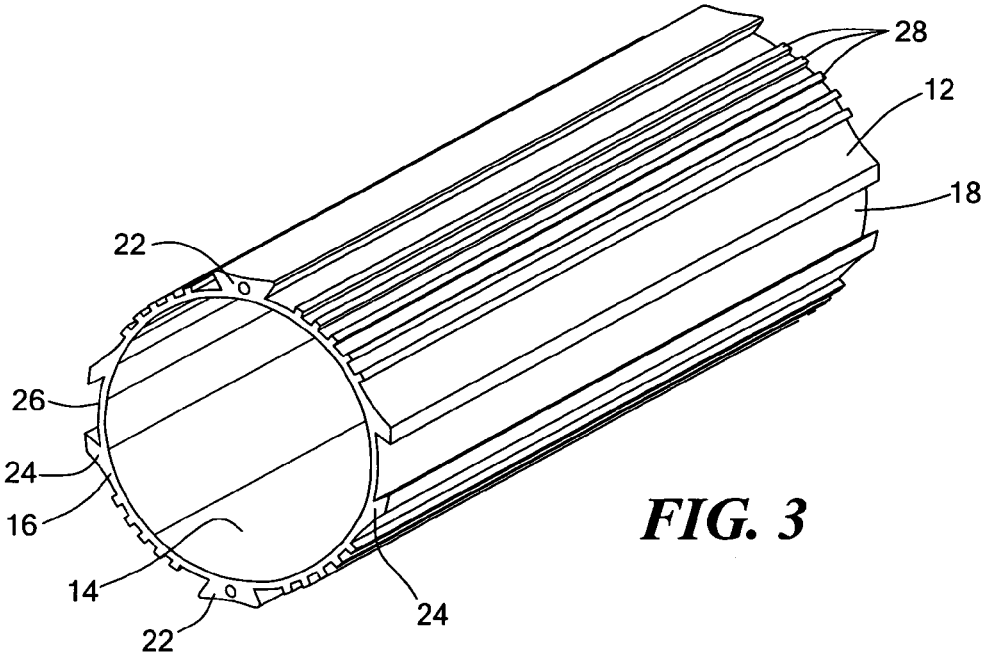
FIG. 3 is an isometric view of the container body of the container of FIG. 1.
Figure 4:
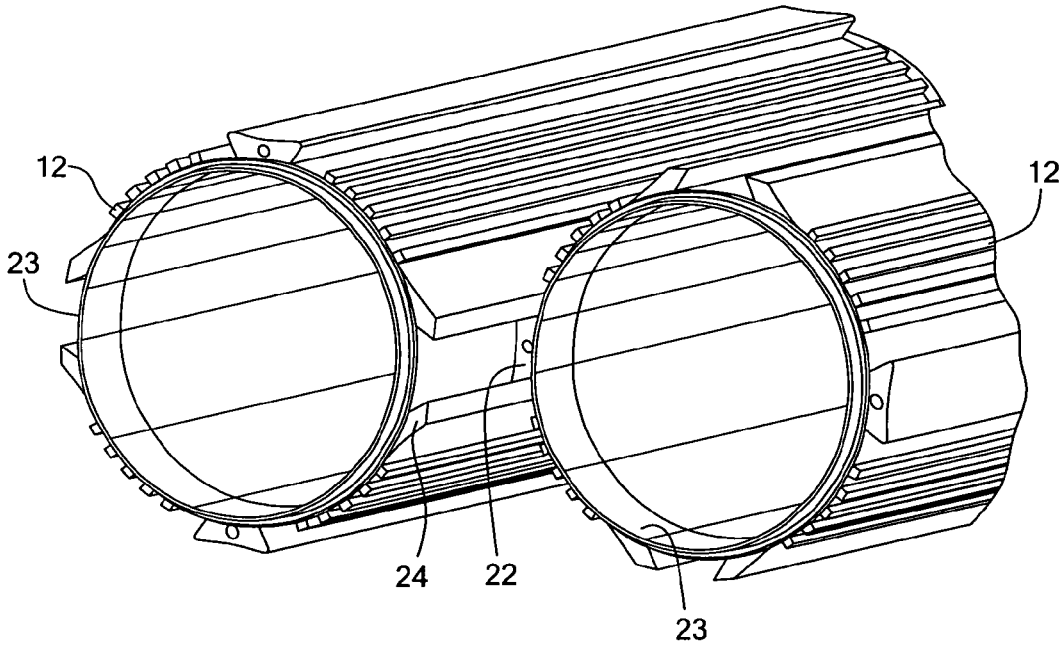
FIG. 4 is an isometric view of two container bodies being interlocked.

To interlock two tubular containers, the end of a tenon interlocking element on one container body is aligned with the end of a corresponding mortise interlocking element on the other container body. The tenon interlocking element is inserted into and slid along the mortise interlocking element (see FIG. 4) to the desired position. By interlocking a number of tubular containers in this manner, a stable stack of containers can be provided, as illustrated in FIG. 2. If desired, the interlocking elements can be machined or otherwise removed at intervals along the length of the container body so that two container bodies can be slid together along shorter distances.

Figure 5:
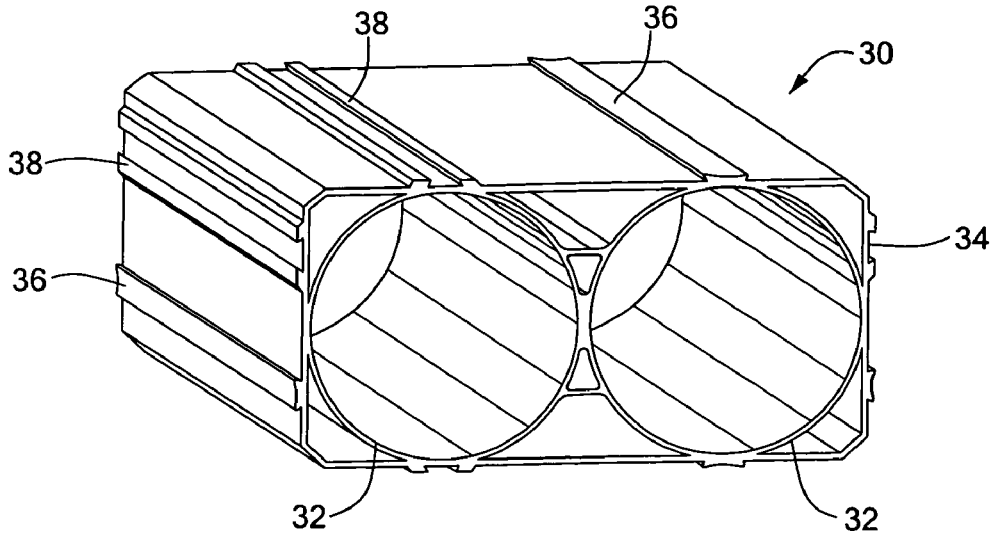
FIG. 5 is an isometric view of a further embodiment of a container body.
Figure 6:
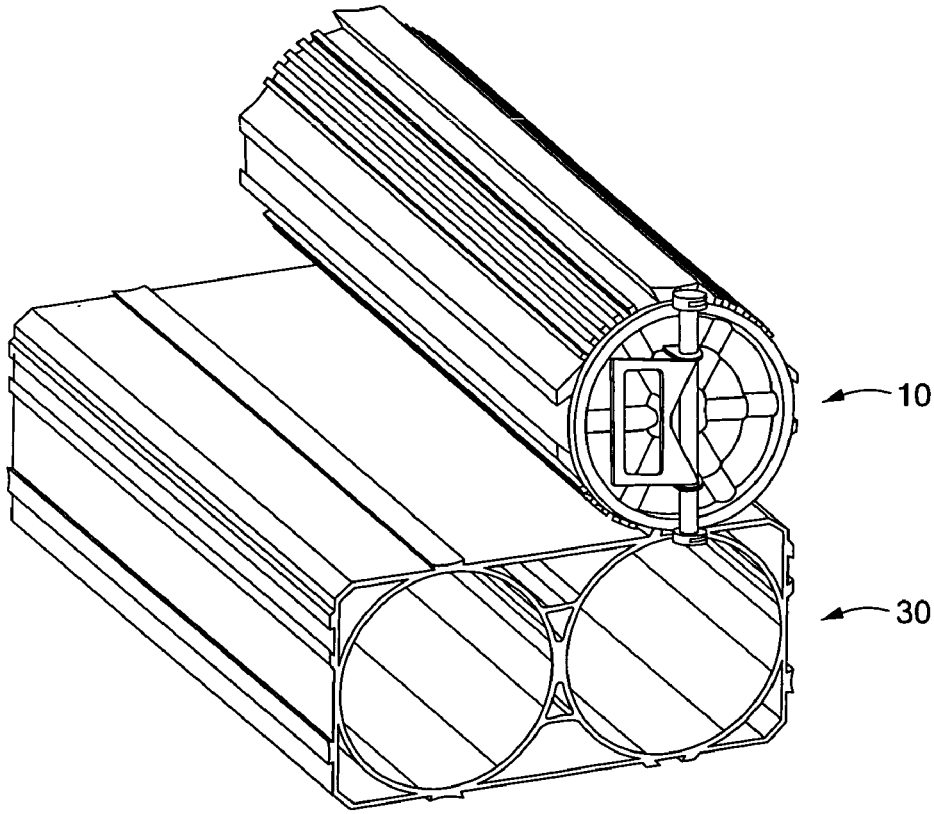
FIG. 6 is an isometric view of a container of FIG. 1 interlocked with a container of FIG. 5.
Figure 7:
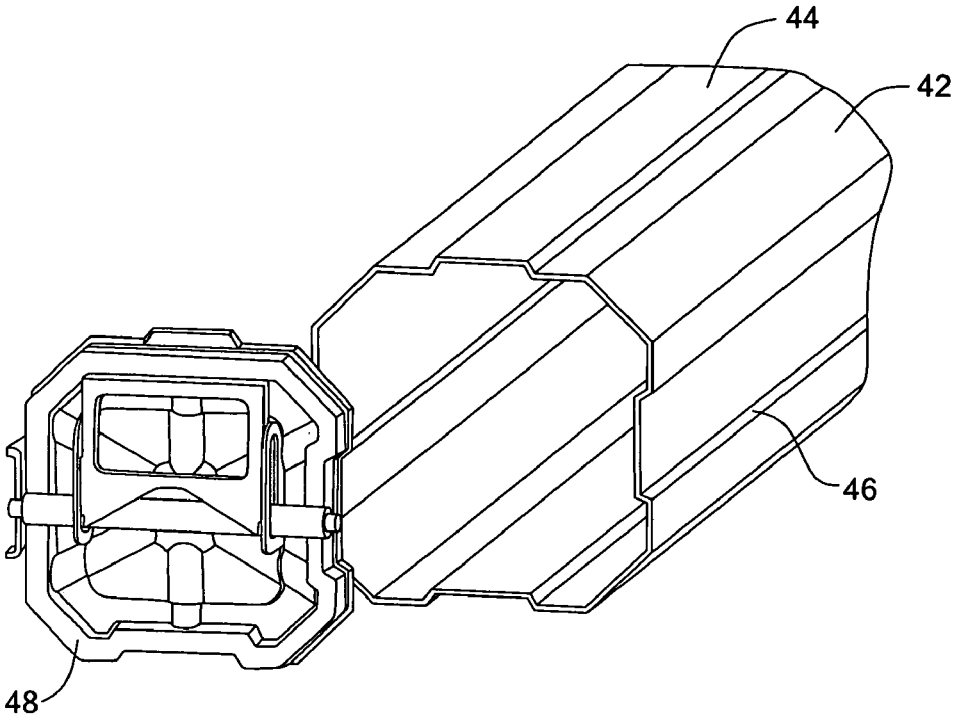
FIG. 7 is an isometric view of a further embodiment of a container.

Other container body configurations and interlocking element configurations are possible. For example, FIG. 5 illustrates a container 30 incorporating integrated circular sleeves 32 within an outer box 34. The interlocking features 36, 38 are included on the outer box. As can be seen in FIG. 6, a round container 10 can be interlocked with the square container 30. A container body 42 having a generally square cross-section is illustrated in FIG. 7. Concave and convex interlocking features 44, 46 extend the length of the container body in the form of channels. Containers are slid into place, interlocking the channels. A closure member 48 has a configuration to conform to the configuration of the container body 42.

The elongated hollow container body has a constant cross-section along its entire length. In this manner, the container body with the interlocking assembly can be readily formed by a pultrusion process, because pultrusion is particularly suitable for forming long parts having constant and accurate cross-sectional features along the entire axial dimension of the part. The pultruded part can be readily cut into smaller parts of the desired length after exiting the pultrusion die.

Figure 8:
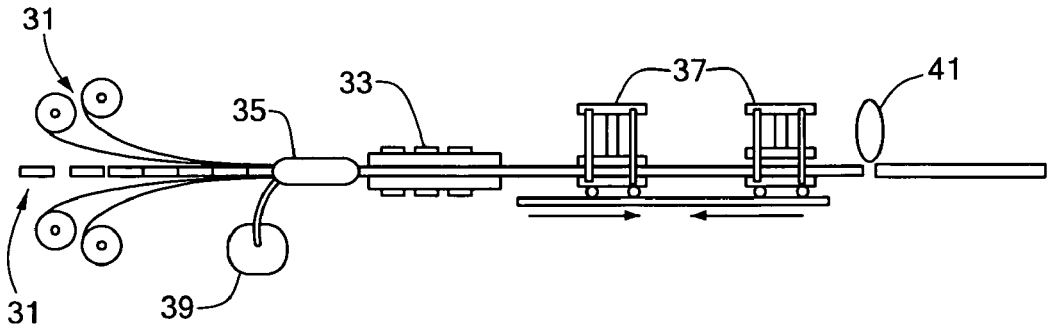
FIG. 8 is a schematic diagram of a pultrusion process.
Figure 9:
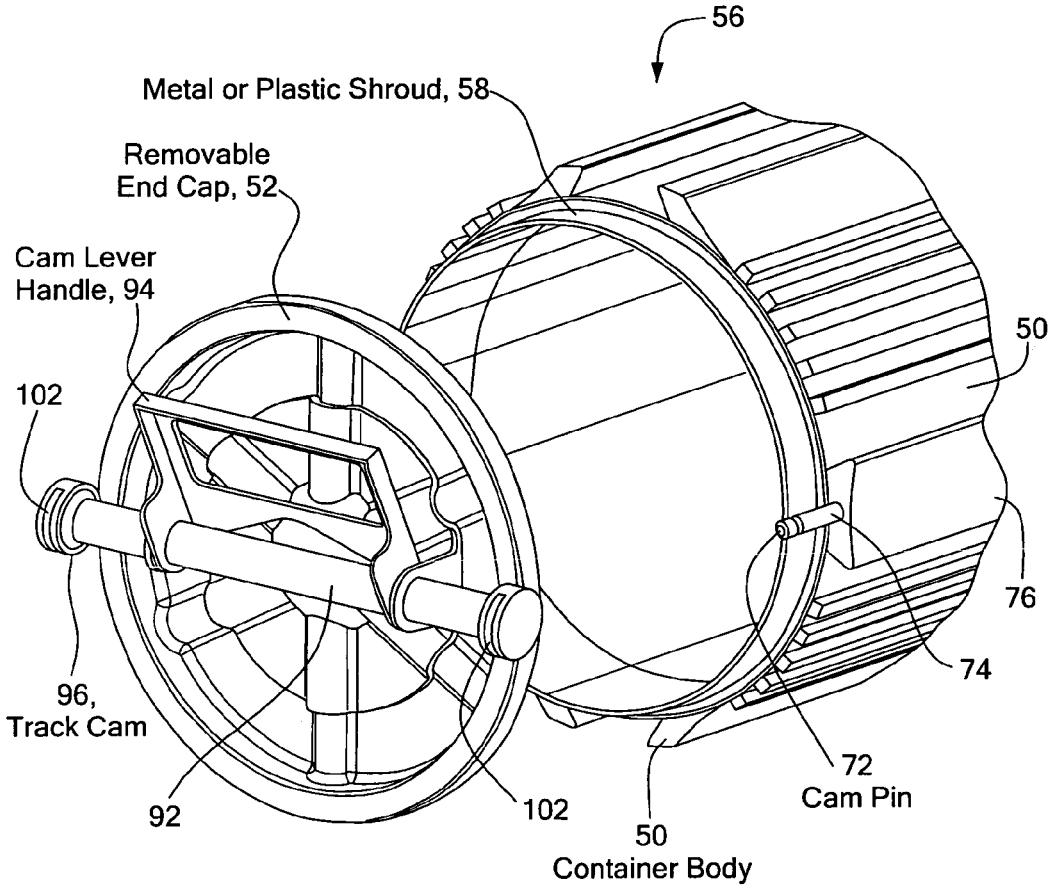
FIG. 9 is an exploded isometric view of a container body, end cap and interface of the container of FIG. 1.

In a pultrusion process (see FIG. 8), reinforcing materials 31 in the form of, for example, dry unidirectional fibers, cloth, multi-axial stitch bonded materials, braided pre-forms and specially-produced two-dimensional and three-dimensional reinforced materials, are continuously pulled from spools or woven in-line prior to being passed through an optional preheating furnace. Preheating dries the materials and improves resin wet-out. The collation of dry reinforcing material then passes through several forming cards before entering a heated steel die 33. The die compacts the material into the final geometry. Free-floating mandrels, often twenty feet or longer in length from their upstream mounting fixture, can extend into the closed cavity of the die to form inner surfaces of the part. Resin from a supply 39 is applied to the fiber preform, either by pulling it through a wet bath or by directly injecting the liquid matrix into the die with an injection tool 35. The wet fiber/resin assembly is cured as it moves through the heated portion of the die. Cured composite parts flow continuously through the pultrusion system by a pair of moving grips 37 that alternate clamping onto and pulling the product from the exit end of the die. Parts can be cut to length with a cut off saw 41 at the exit end.

Pultrusion allows the container body to be constructed of lightweight, stiff, strong, and durable fiber-reinforced composite materials. Such materials are lightweight, low-cost, and can be biodegradable, fire resistant, and impact resilient. Composite materials allow tailoring of mechanical, electrical and chemical performance requirements. Suitable fiber reinforcement includes glass fibers and carbon fibers. Suitable matrix materials include vinyl esters and epoxies.

The container body can have a sandwich structure with a relatively compliant core material encapsulated within inner and outer layers of fiber reinforced plastic laminates. Glass fibers or commingled textile structures in a matrix material, for example, of vinyl ester, provide suitable inner and outer sandwich sheets, since they have favorable energy absorption properties. Highly porous polymer-based materials, such as CORMAT® or SORIC®, or syntactic films such as Loctite's SYNCORE®, can be used for the core.

Other processes to make tubular structures, such as filament winding, braiding, resin transfer molding (RTM), and vacuum-assisted resin transfer molding (VARTM), can be used, although these processes are generally more costly for making constant cross section tubular structures than pultrusion processes.

As noted above, a closure member or end cap 20 is provided to close the ends of the container body 12. A latching mechanism 21 is provided to close and tighten the end cap to the container body. The end cap can be of any suitable material, such as metal or a composite material. An interface 23, such as a shroud, between the end cap and the container body (see FIG. 4) ensures a good seal, such as if air or liquid tightness is desired. The interface also protects the free fiber edges of the container body from delaminating, brooming, or cracking.

Figure 12:
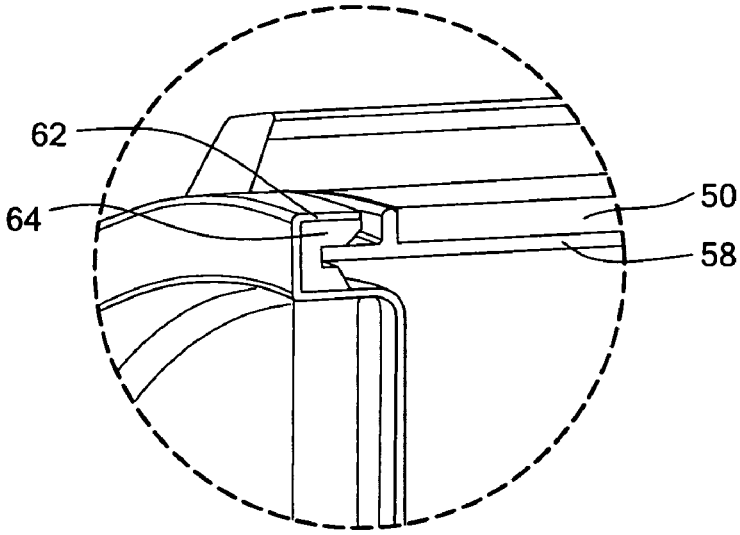
FIG. 12 is a partial cutaway view of the shroud interface of the container of FIG. 9.
Figure 13:
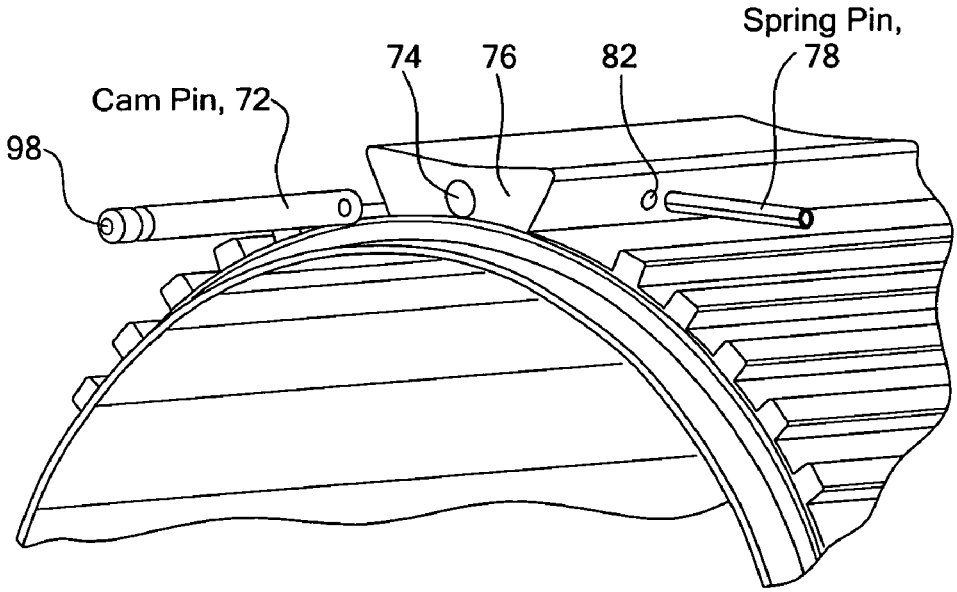
FIG. 13 is a partial view of the container body, shroud, interface, and cam latching mechanism of FIG. 9.
Figure 14A:
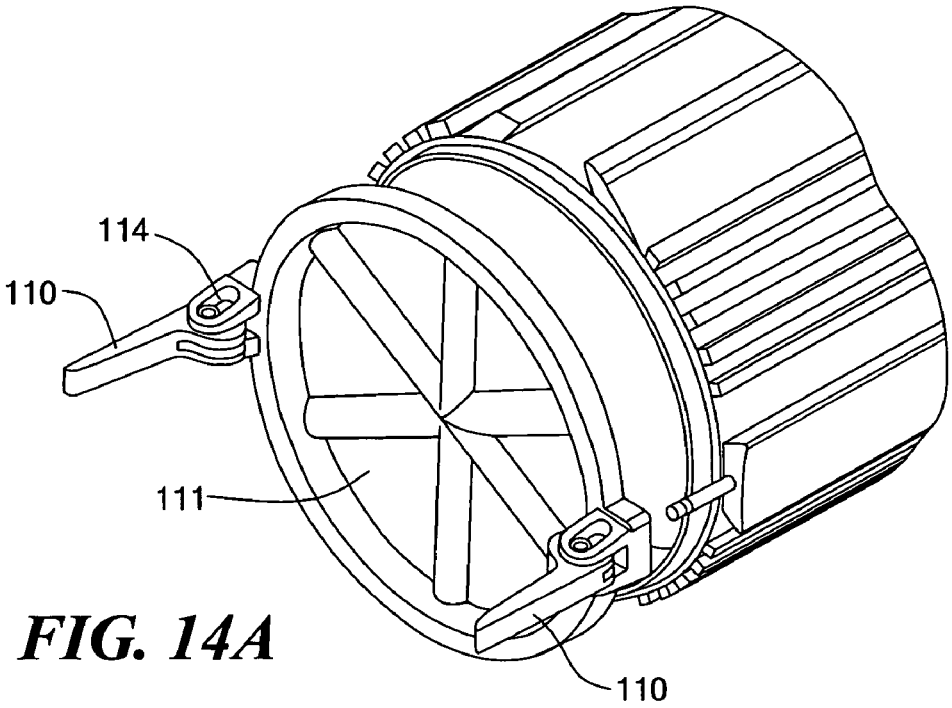
FIG. 14A is a partial exploded isometric view of a further embodiment of an end cap.
Figure 14B:
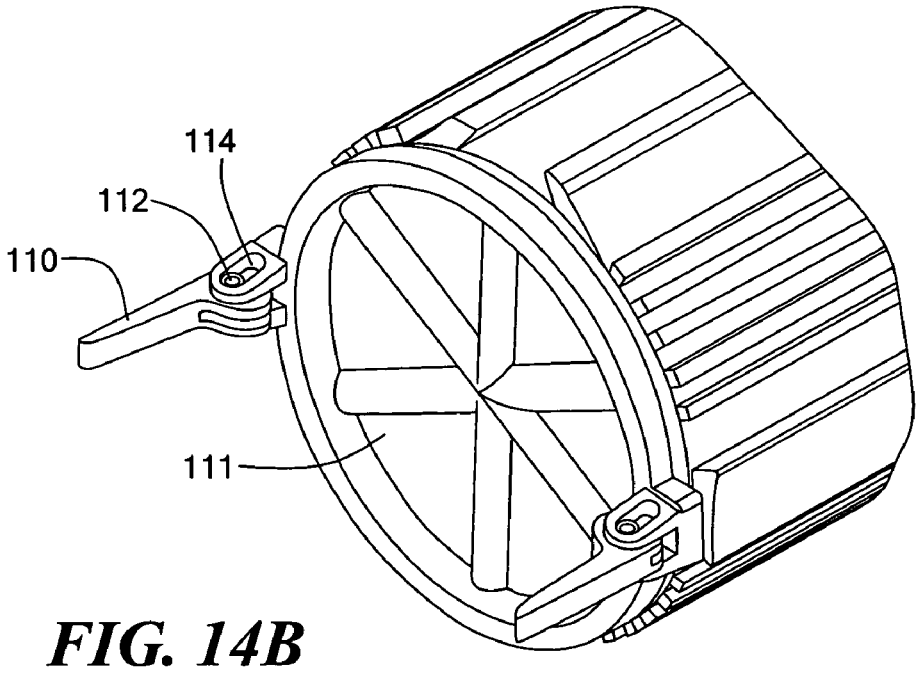
FIG. 14B is a partial isometric view of the end cap of FIG. 14A on the container body.
Figure 14C:
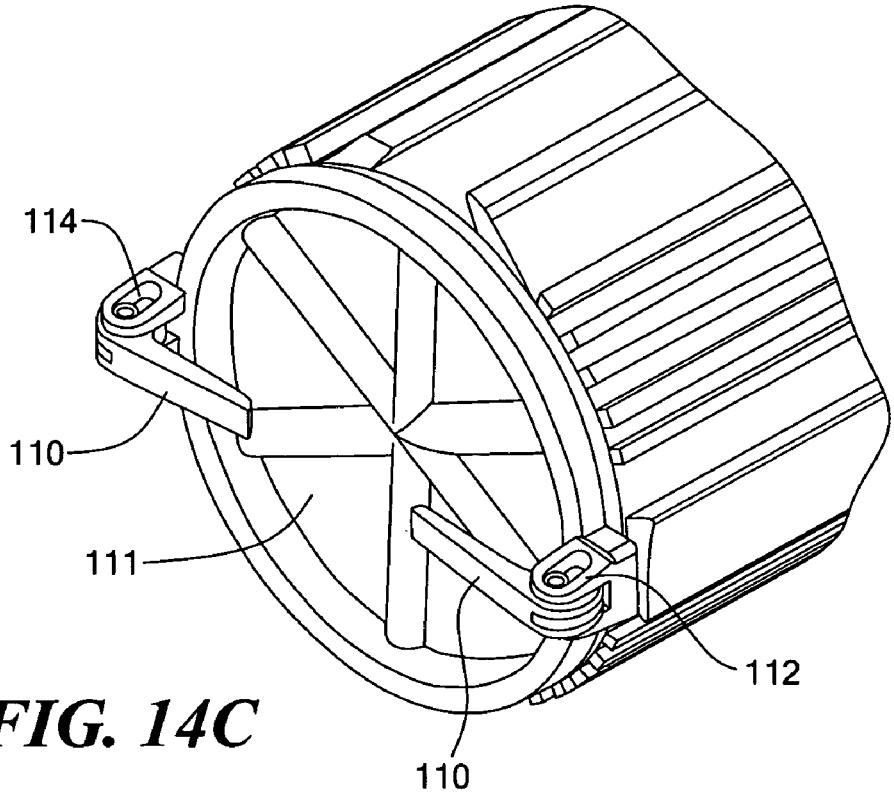
FIG. 14C is a partial isometric view of the end cap latched onto the container body.
Figure 15:
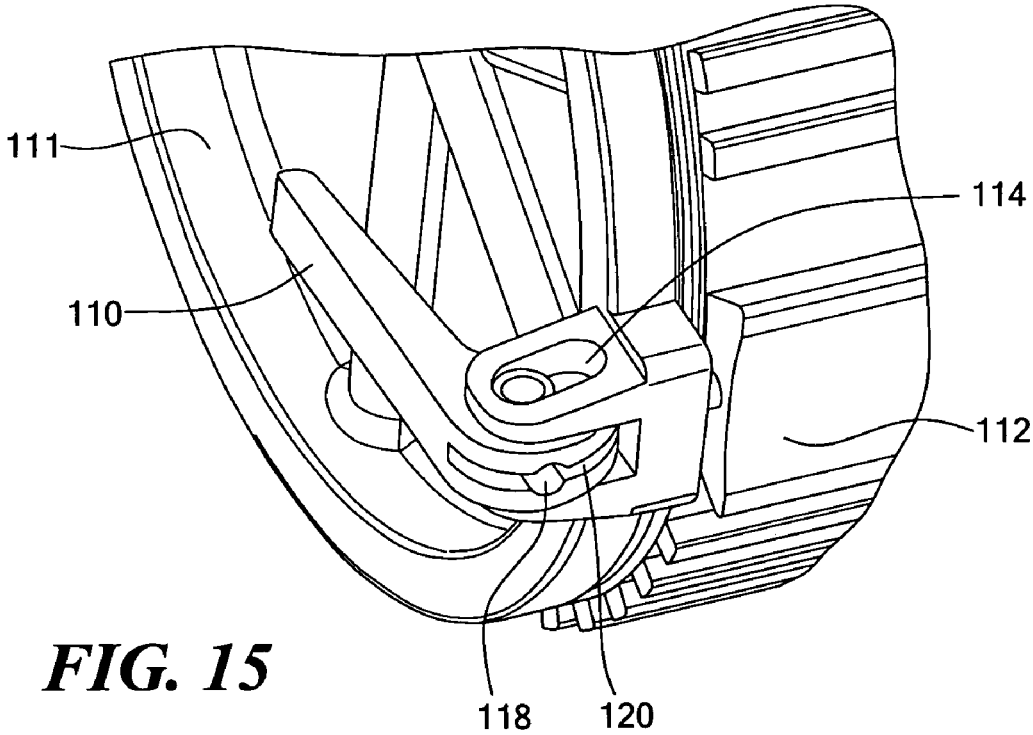
FIG. 15 is a partial view of the end cap and container body of FIGS. 14A-C.
Figure 16:
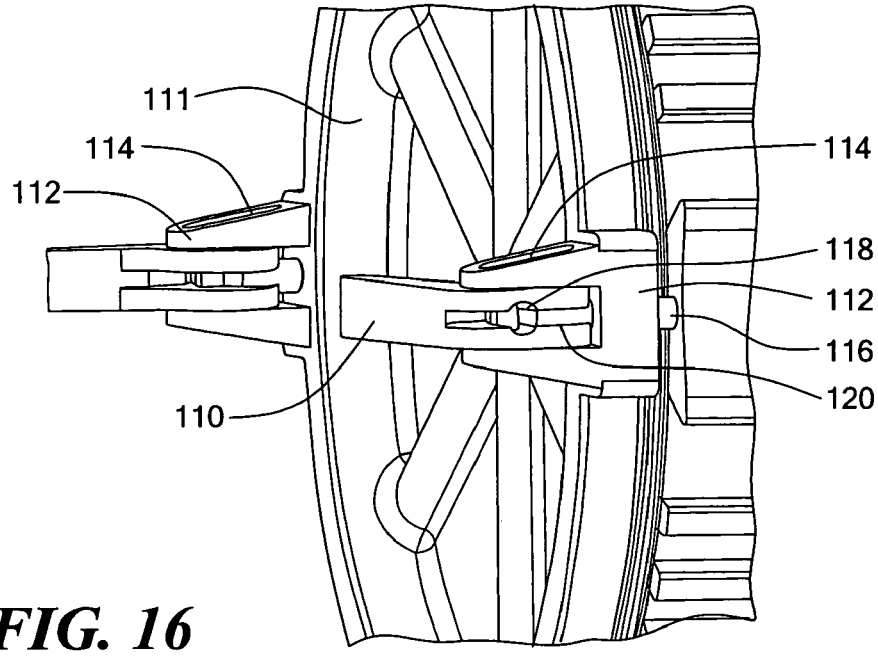
FIG. 16 is a partial isometric view of the end cap and container of FIGS. 14A-C in a partially latched configuration.

An exemplary removable closure member or end cap 52 incorporating a cam latching mechanism 54 is illustrated more particularly in FIGS. 9-13. An interface 56 is provided as a shroud 58 bonded, crimped, or otherwise attached to the end of the elongated hollow container body 50 in any suitable manner. The end cap includes an annular recess 62 formed along its perimeter (FIGS. 11-12). A gasket 64 fits within the recess. The end of the shroud 58 is inserted into the recess in sealing engagement with the gasket. The shroud improves sealing wear and prevents the possibility of brooming at the embedded fiber ends.

A pair of cam pins 72 is inserted in openings 74 in the end of the container body 50. The openings can be readily formed in the tenons 76 of the interlocking elements during the pultrusion process and thus extend the length of the body. The cam pins can be held in place in the openings, for example, by a spring pin 78 inserted through an aperture 82 in the tenon aligned with a corresponding aperture in the cam pin. See FIG. 13.

Figure 10A:
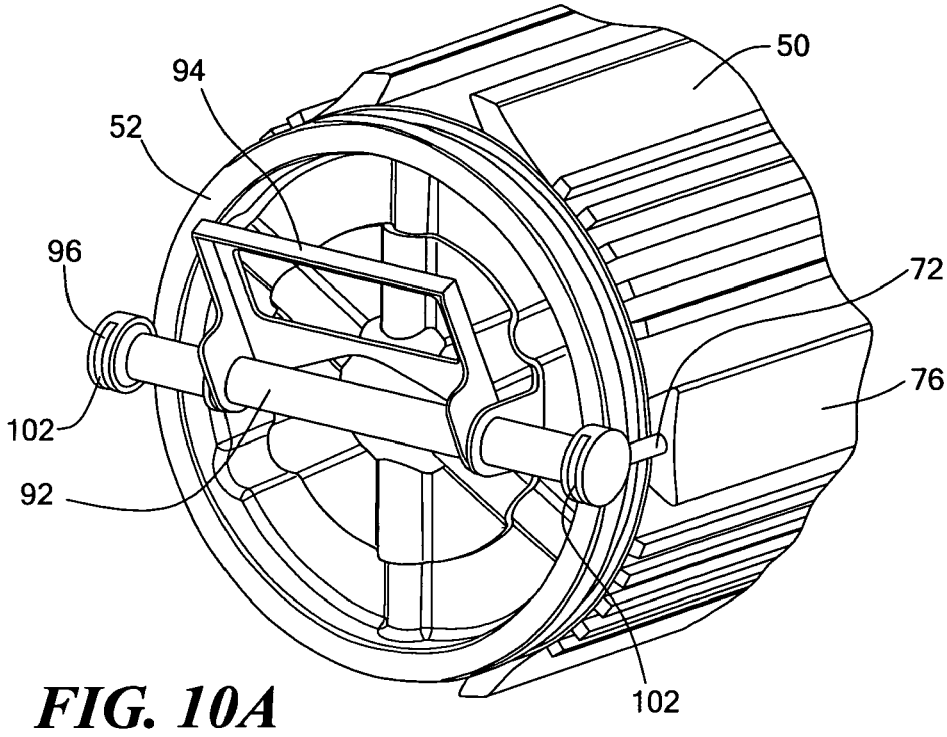
FIG. 10A is an isometric view of the container of FIG. 9 with the end cap placed on the container body.
Figure 10B:
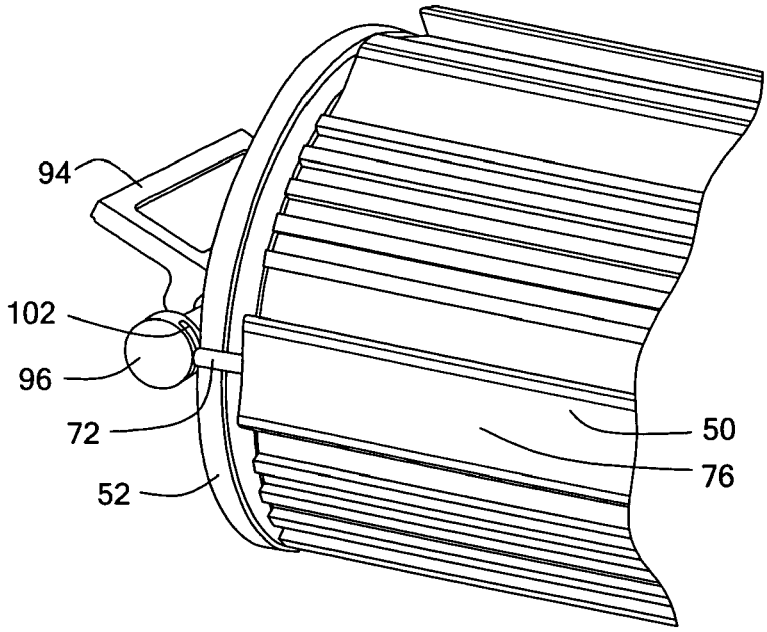
FIG. 10B is an isometric view of the container of FIG. 10A showing a cam latching mechanism.

A rotatable shaft 92 extends across the diameter of the end cap 52. A handle 94 on the shaft is movable between an unlocking position (up in FIG. 10A) and a locking position (down in FIG. 10C). Track cams 96 are fixed at either end of the shaft to engage a ball 98 on the end of each cam pin 72. The track 102 has a decreasing radius with respect to the axis of the shaft. Once the cam pins are inserted into the track cams, the handle can be rotated down, as illustrated in FIGS. 10B and 10C. The ball rides along the decreasing radius of the cam track, pulling the end cap and gasket against the container body and creating a seal.

With this closure member, the machining of the apertures for the spring pins is the only secondary machining operation required for container assembly, aside from cutting the container body to length during the pultrusion process. Thus, this cam and pin arrangement minimizes the secondary operations and costs associated with closing the container body.

Furthermore, this closure arrangement between end cap, shroud and container body removes reliance on the secondary bond between the shroud and the container body. The shroud is essentially sandwiched between the body and the end cap when the cap lever is latched. Also, the pin and cam arrangement makes efficient use of materials and packaging space. Additionally, this arrangement does not require penetrating the container body wall to attach hardware, such as clasp or cleat components. Penetrating the container body wall presents sealing problems and requires additional manufacturing operations that are obviated by the present invention.

The handle, shaft, and cam ends of the end cap and the pin are preferably metal, such as steel. The remainder of the end cap can be of metal or a composite material. The shroud can be made of metal or a composite material. The shroud is particularly useful to provide an interface between a container body of a composite material and an end cap of metal. The shroud can optionally be eliminated, depending on the requirements of the application.

In a further embodiment of a latching mechanism illustrated in FIGS. 14A-16, dual independent cam levers 110 on the end cap 111 apply the clamping preload. Clevises 112 integral to the end cap include slots 114 to allow the levers to float towards and away from the end cap while allowing contact with the cap face. The pin 116 engages the cam lever through a hole 118 at the base of the cam profile and slides in a constant radius track 120 in the lever when the lever is actuated. In this case, the radial cam action exists at the surface of the lever rather than internally.

Figure 17:
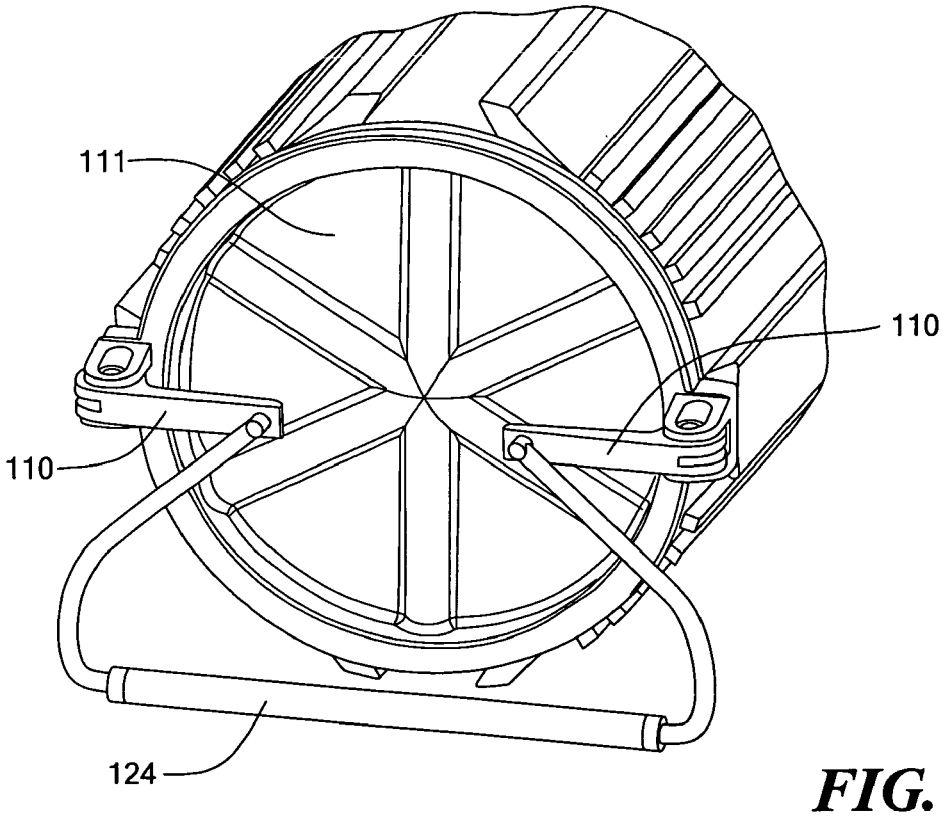
FIG. 17 is a partial isometric view of the end cap of FIGS. 14A-C with a pull handle.
Figure 18:
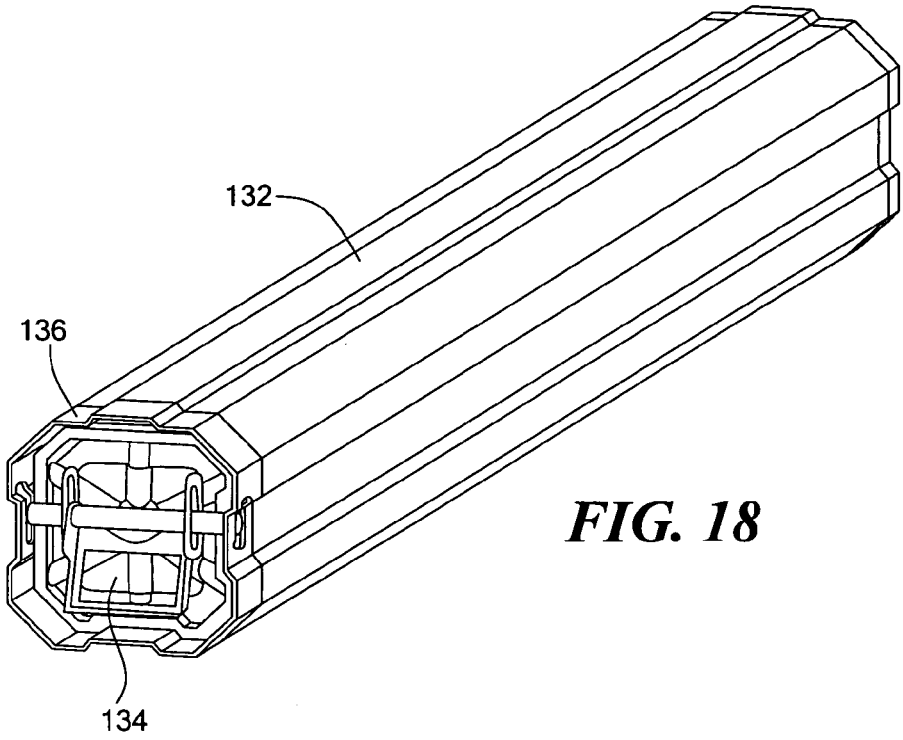
FIG. 18 is an isometric view of a further embodiment of a container.
Figure 19:
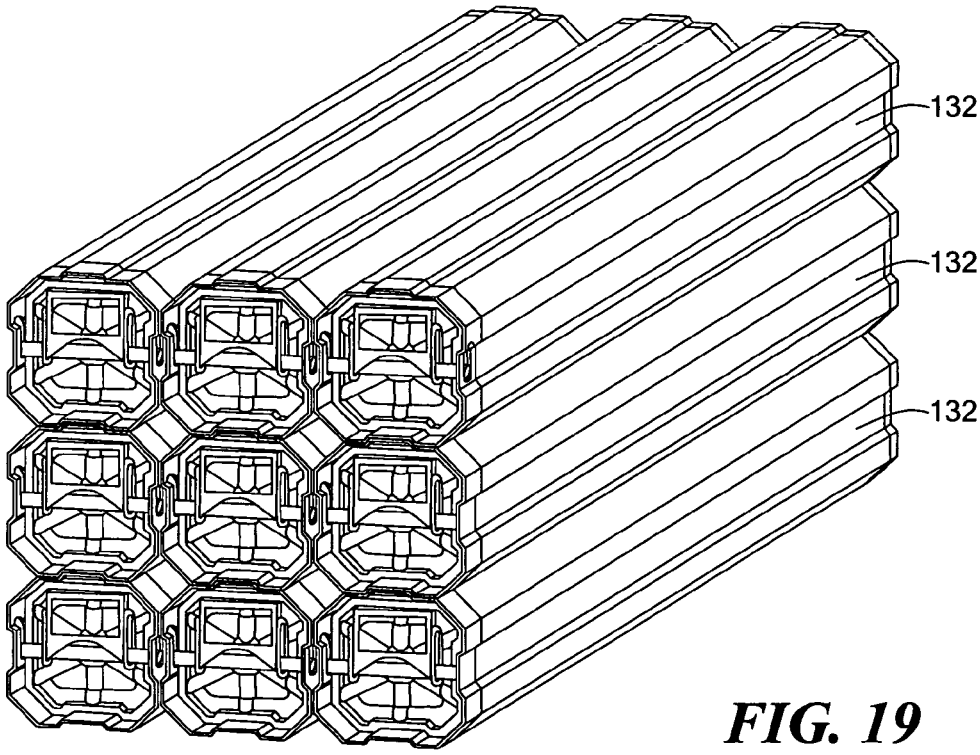
FIG. 19 is an isometric view of containers of FIG. 18 arranged in a stacked.
Figure 20:
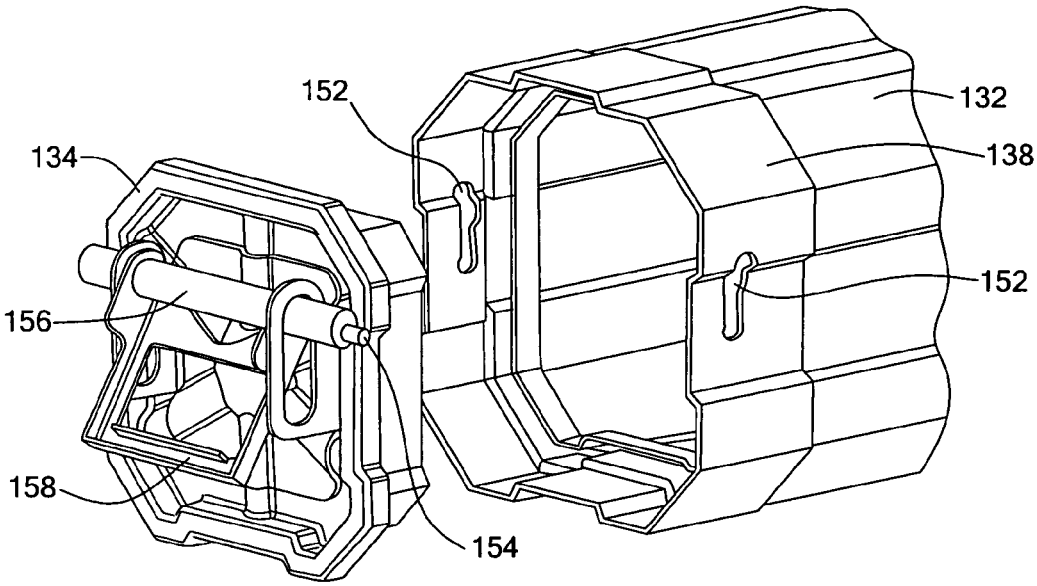
FIG. 20 is an exploded partial isometric view of the end cap, interface, and container body of FIG. 18.
Figure 21:
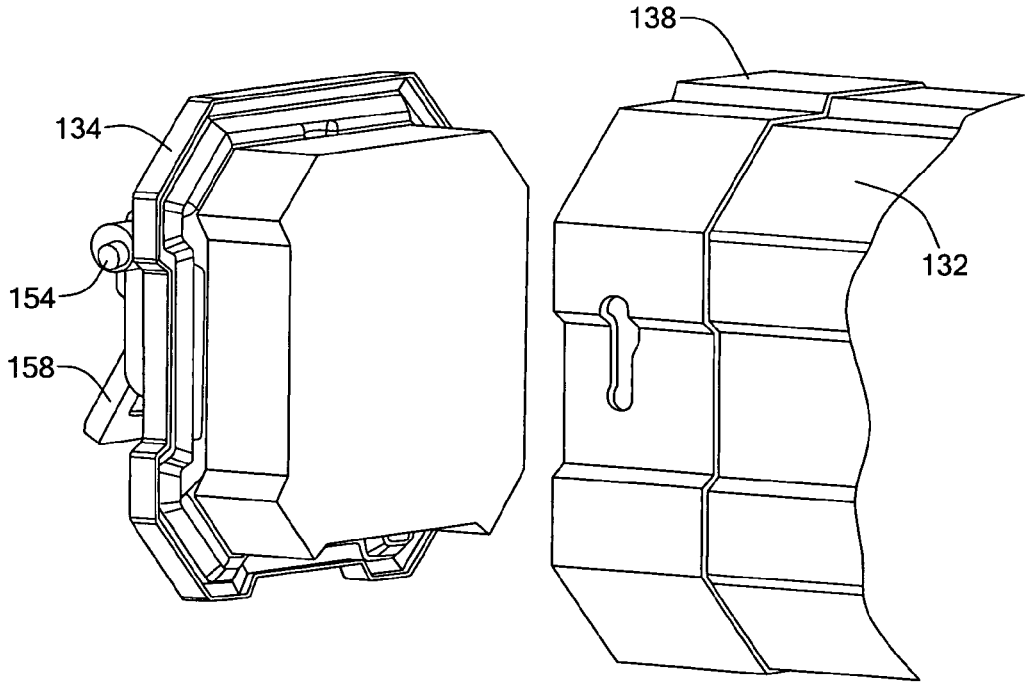
FIG. 21 is an exploded partial isometric view of the end cap, interface, and container body of FIG. 18.

As illustrated in FIG. 17, a cable loop pull handle 124 can be attached to the levers to allow the end cap 111 to be unlocked with one action rather than two. Thus, pulling the cable simultaneously actuates both split cam levers.

Figure 22:
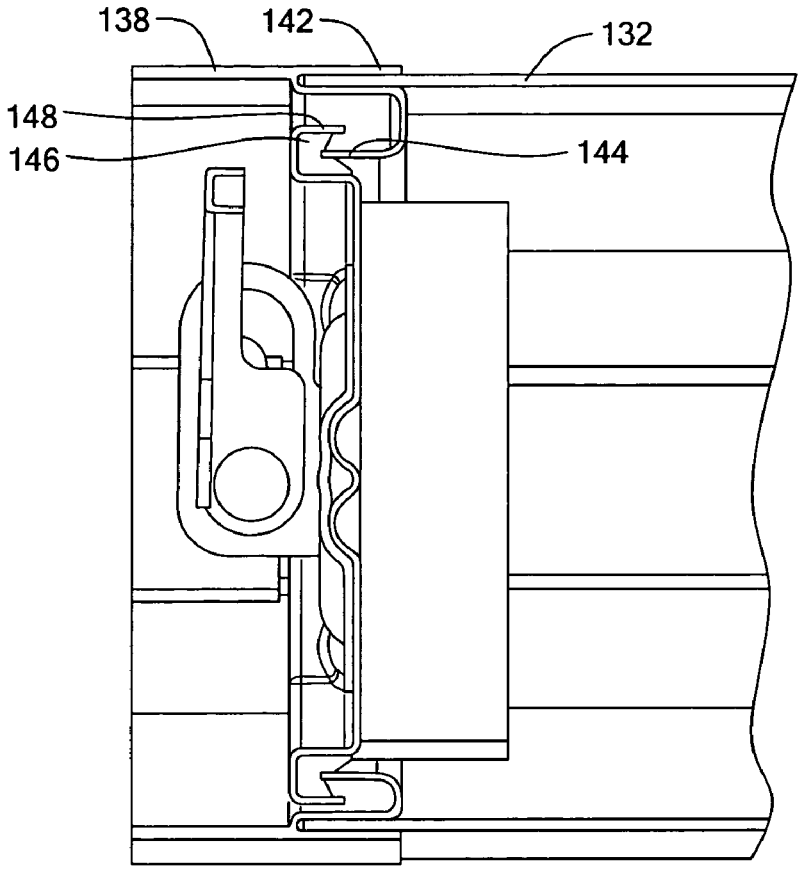
FIG. 22 is a cutaway view of the end cap, interface, and container body of FIG. 18.
Figure 23:
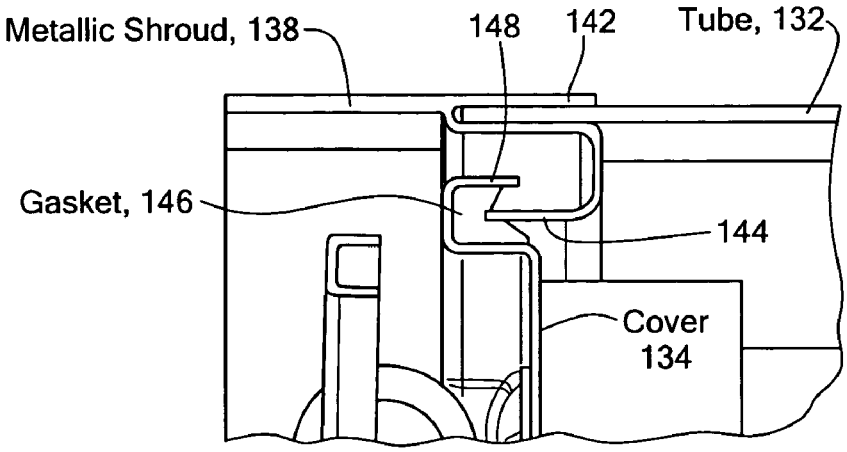
FIG. 23 is a cutaway view of the shroud interface of FIG. 22.
Figure 24C:
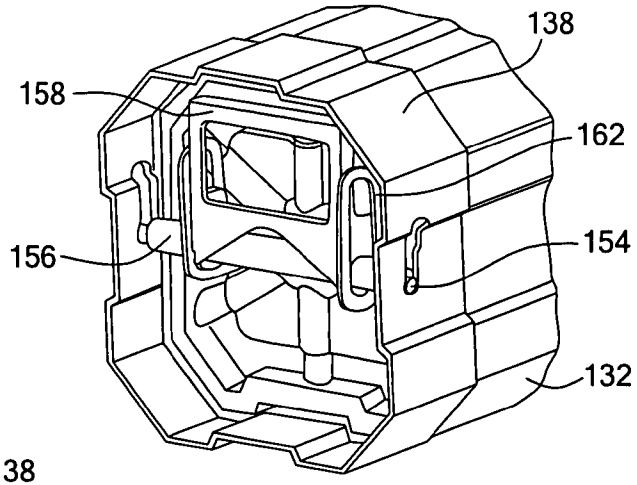
FIG. 24C is an isometric view of the container of FIG. 18 with the end cap latched to the container body.
Figure 24B:
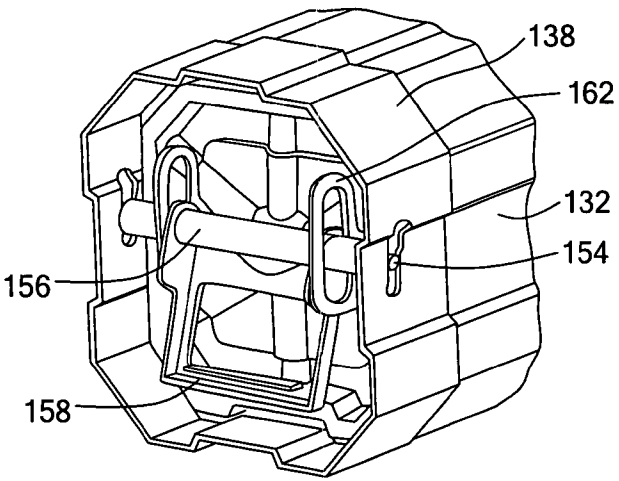
FIG. 24B is an isometric view of the container of FIG. 18 with the end cap partially latched.
Figure 24A:
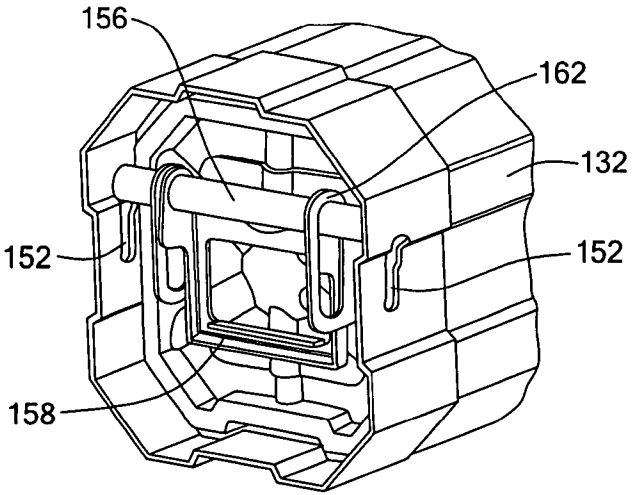
FIG. 24A is an isometric view of the container of FIG. 18 with the end cap placed on the container body and shroud.
Figure 25:
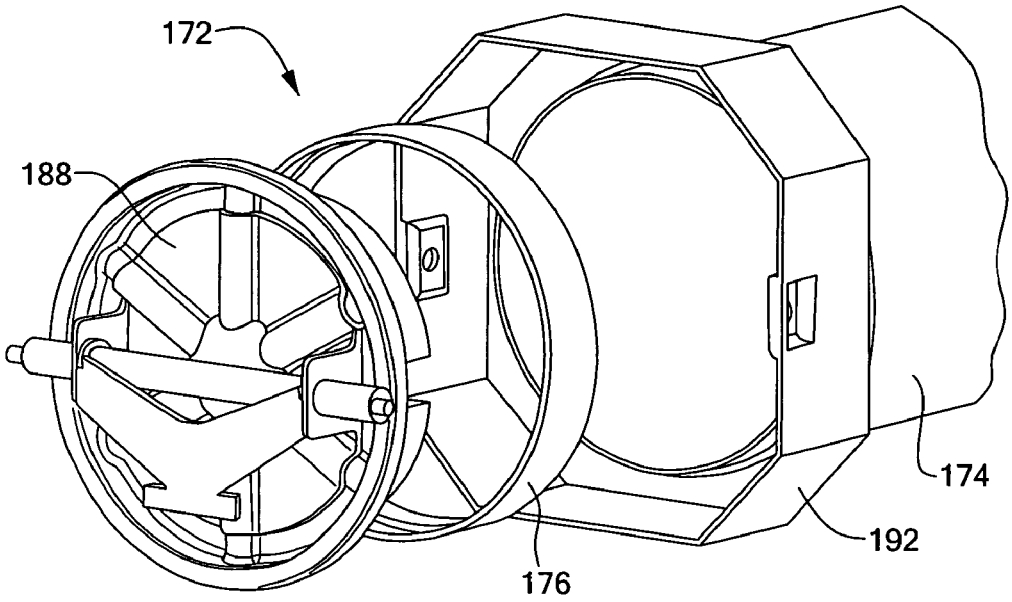
FIG. 25 is an isometric exploded view of a further embodiment of an interface and closure mechanism.
Figure 26:
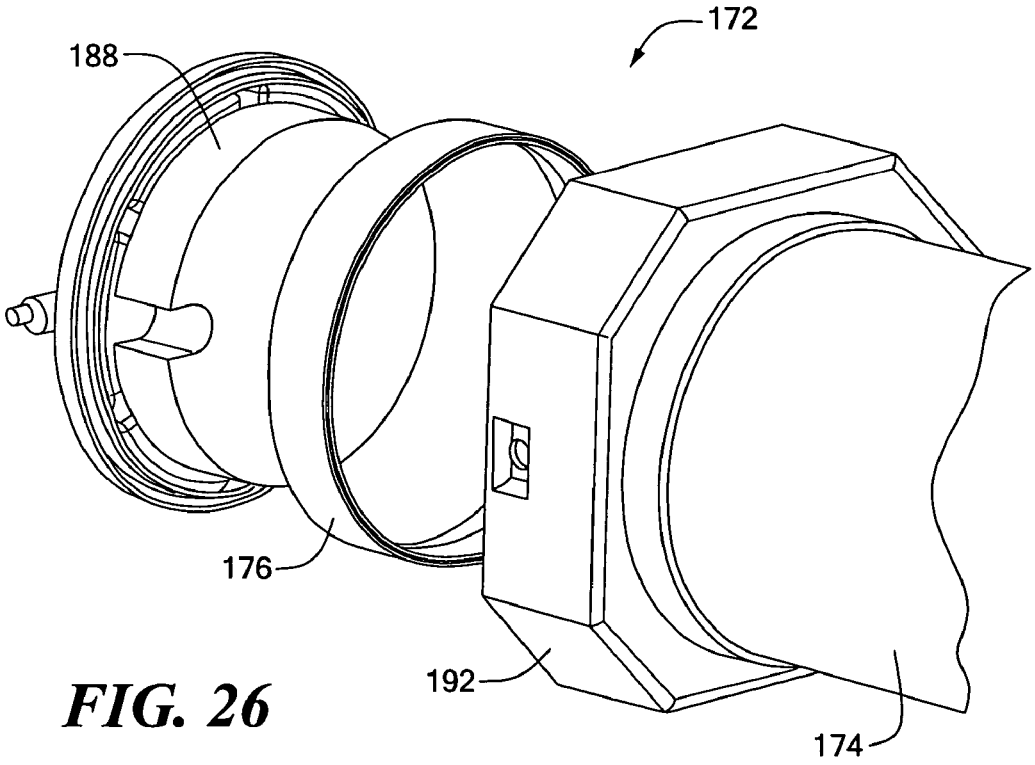
FIG. 26 is an isometric exploded view of the interface and closure mechanism of FIG. 25.
Figure 27:
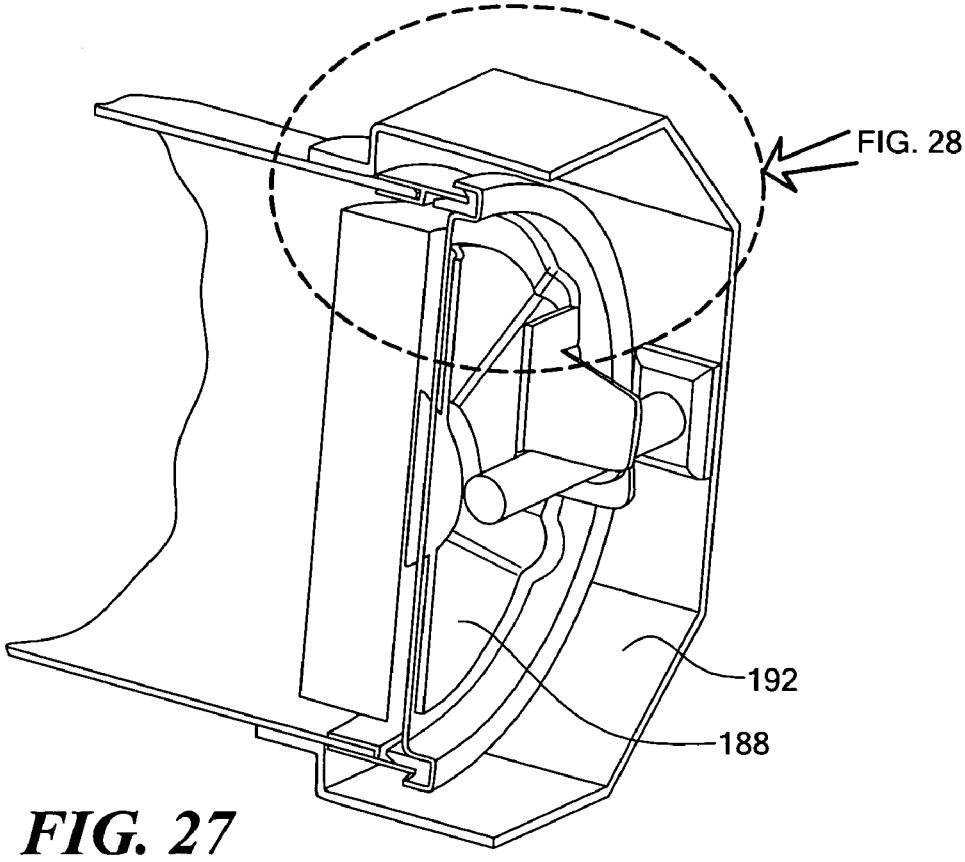
FIG. 27 is a cutaway view of the interface and closure mechanism of FIG. 25.
Figure 28:
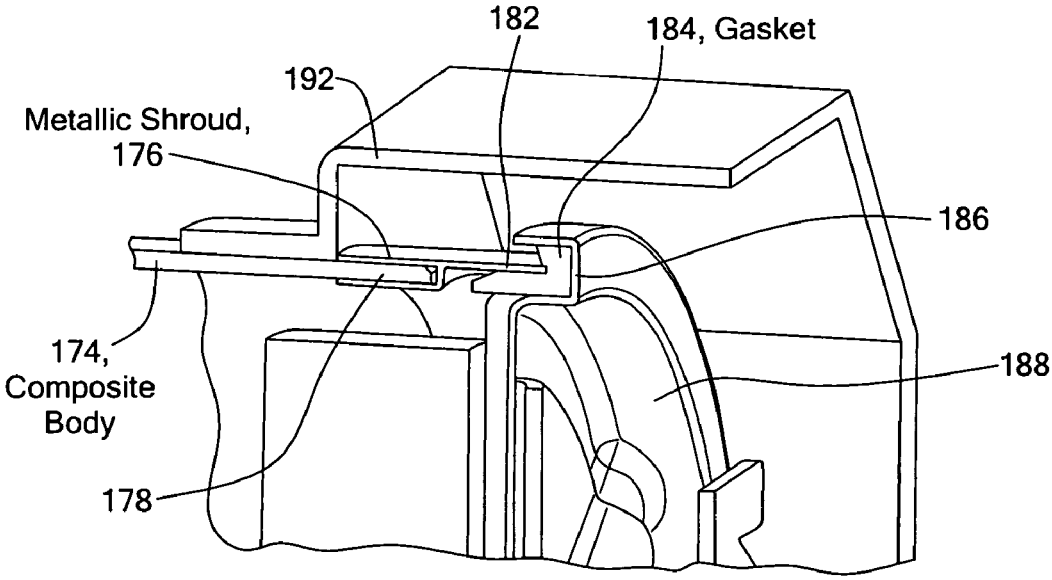
FIG. 28 is a cutaway view of the interface of FIG. 25.
Figure 29:
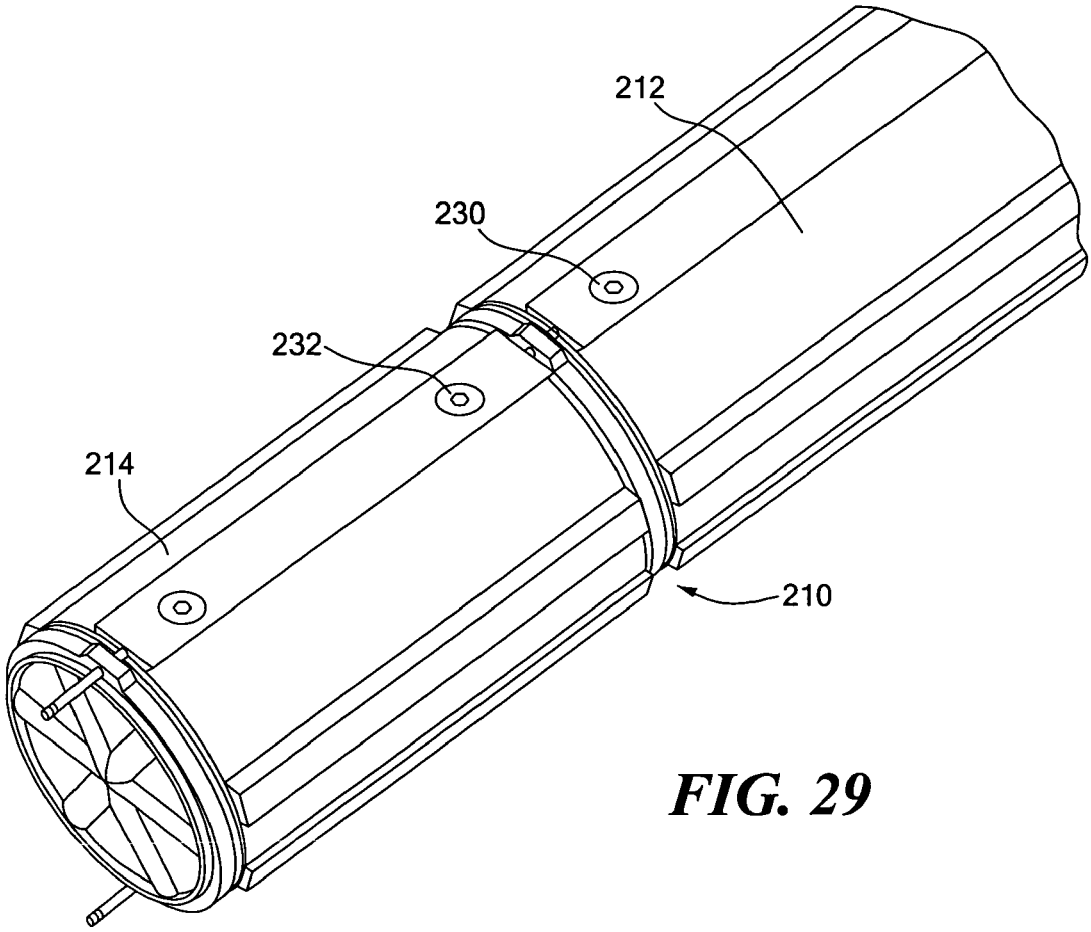
FIG. 29 is an isometric view of an embodiment of an intermediate interface for joining two container bodies.
Figure 30:
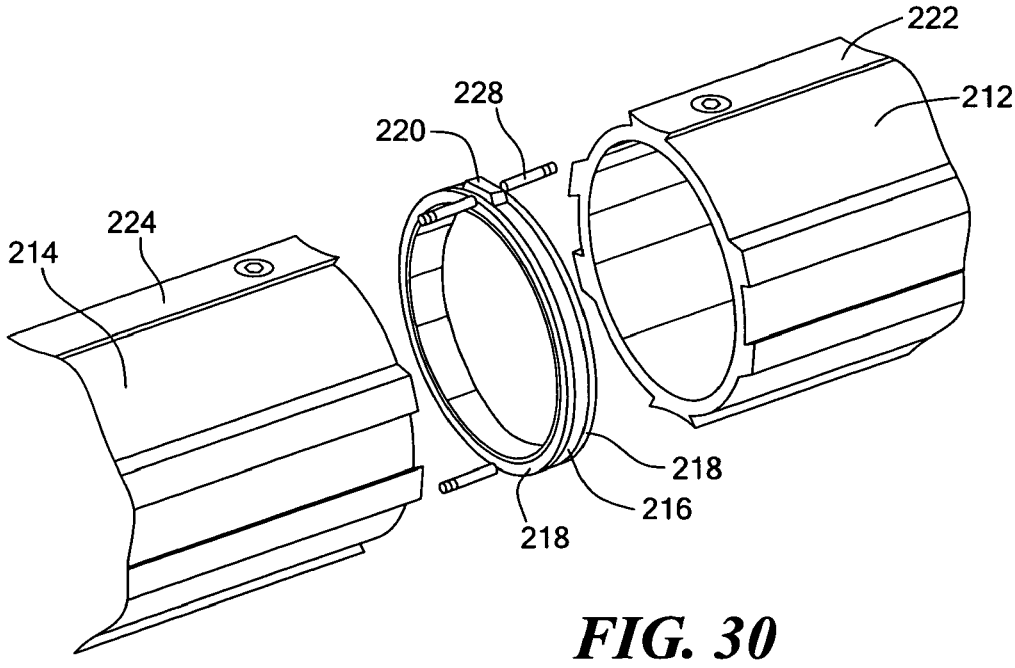
FIG. 30 is an exploded isometric view of the intermediate interface of FIG. 29.
Figure 31:
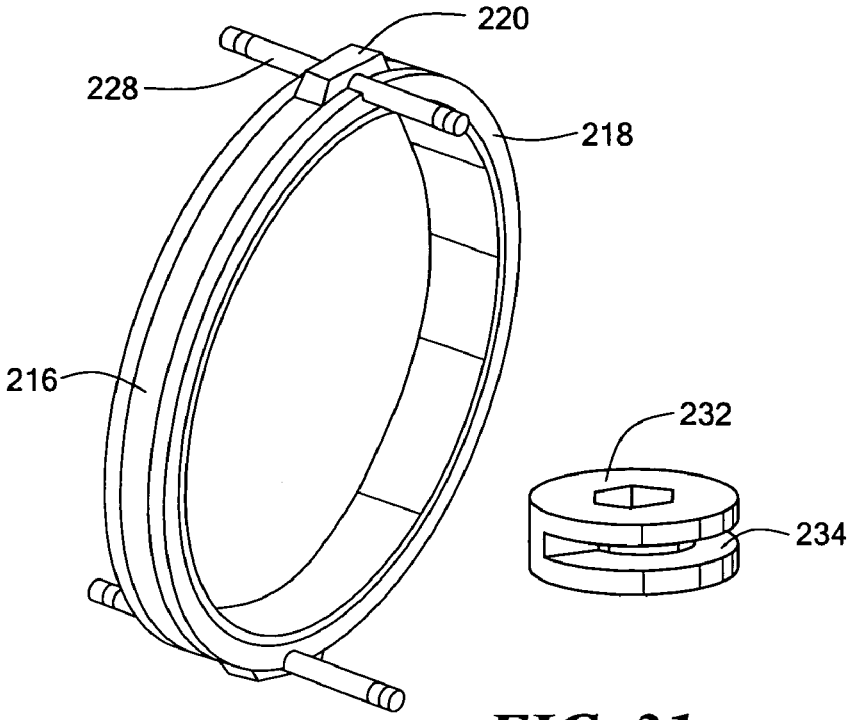
FIG. 31 is an isometric view of the intermediate interface of FIG. 29.
Figure 32:
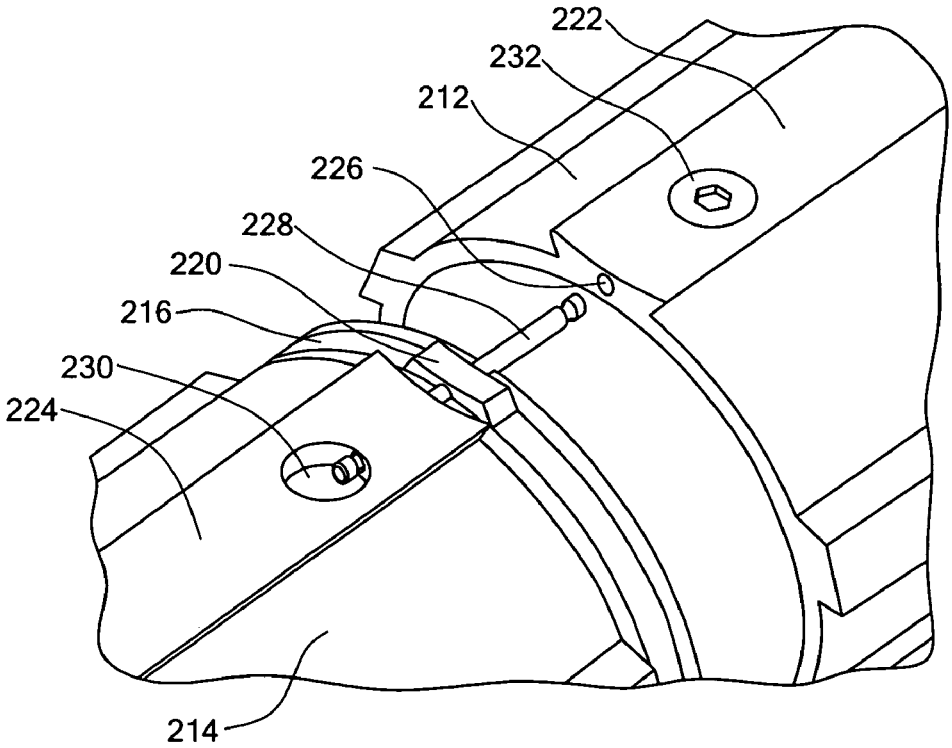
FIG. 32 is a partial view of the latching mechanism of the intermediate interface of FIG. 29.

FIGS. 18-24 illustrate a further embodiment of a closure member 134 and interface 136, shown with a generally square container body 132. The interface is formed as a shroud 138 having the configuration of the container body. The shroud includes a recess 142 that fits over the edge of the container body, protecting both the inner and outer surfaces of the container body edge (FIGS. 22 and 23). An inwardly extending lip 144 fits within a gasket 146 placed in a seat or recess 148 in the closure member (FIGS. 22, 23). A pair of opposed slots 152 are provided in the shroud. Pins 154 on ends of a shaft 156 on the cover engage in the slots. A handle 158 and cam 162 are pulled downwardly until the cams engage the slot stops (FIG. 24A). The handle is then rotated upwardly to lock and preload the cover, moving the pins 154 downwardly and outwardly along the surface of the slot 152 (FIGS. 24B, 24C).

Referring to FIGS. 25-28, an interface 172 includes a shroud 176 having a recess 178 that fits over the edge of a container body 174, protecting both the inner and outer surfaces of the container body edge. An outer lip 182 fits within a gasket 184 placed in a seat or recess 186 in a closure member 188. The interface is shown in conjunction with an outer housing or collar 192 fastened to the round container body to provide a profile with flat surfaces.

Figure 33:
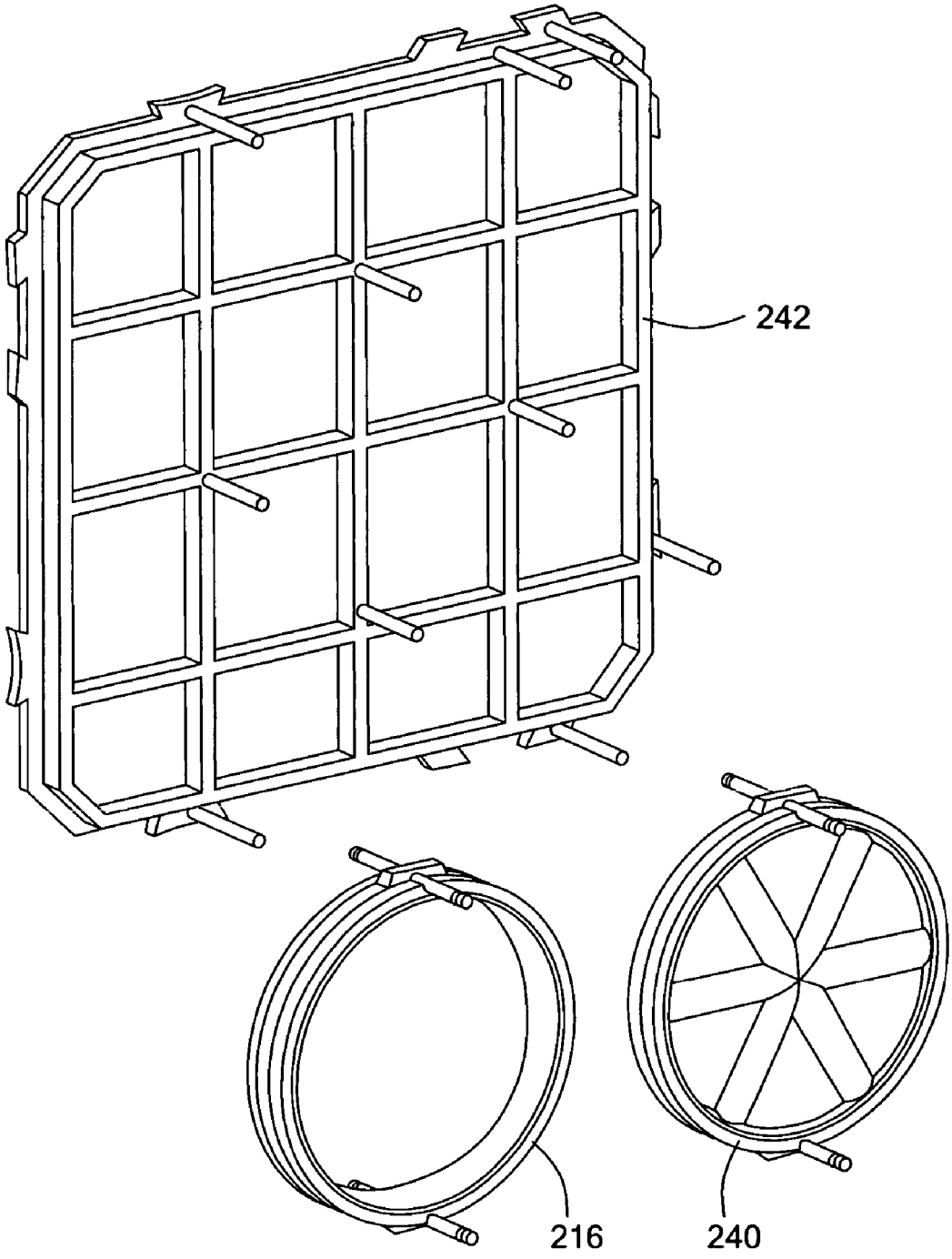
FIG. 33 is an isometric view of several closure mechanisms of the present invention.
Figure 34:
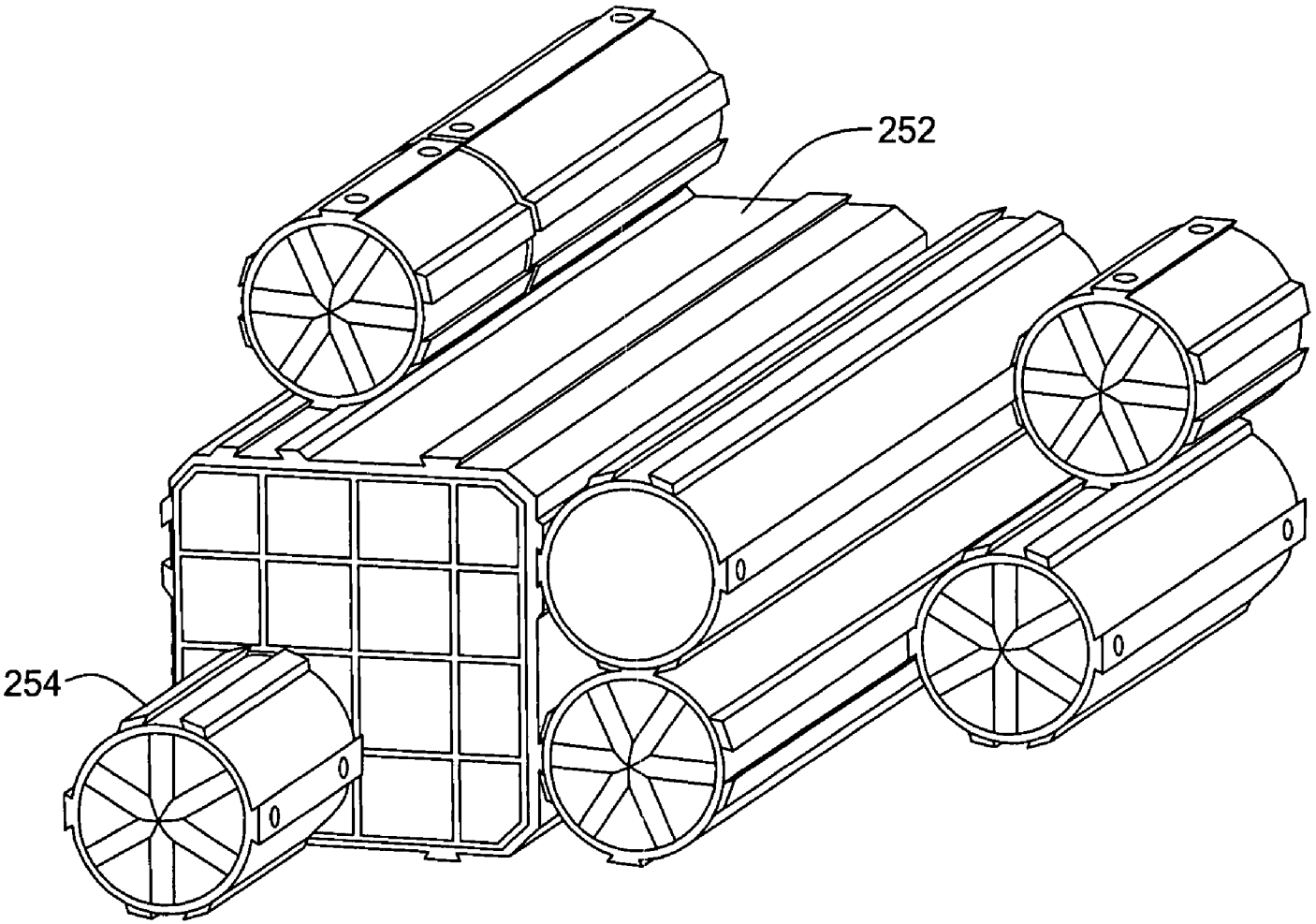
FIG. 34 is an isometric view of several containers arranged in a stack.

FIGS. 29-32 illustrate an intermediate interface 210 for joining two container bodies 212, 214 together. The intermediate interface includes an adapter ring element 216 that fits between the two bodies. A gasket 218 may be provided on each perimeter of the adapter ring element to seal against the ends of the container bodies. The adapter ring element includes a joining element 220 that aligns with the axially extending interlocking elements 222, 224 on the bodies. The interlocking elements include an axially extending aperture 226 into which a ball-headed pin 228 fits. The pin also extend through an aperture in or is otherwise affixed to the joining element 220. An opening 230 is provided in the interlocking elements. A cam 232 fits within the opening. One end of the ball-headed pin extends into a track 234 in the cam in the opening 230. Rotation of the cam clamps the adapter ring via the ball-headed pin to the container body. A similar cam is provided in the opening on the other container body. In this manner, the two container bodies can be joined together. It will be appreciated that the adapter ring can also include an interface, such as a shroud, as described above. The adapter ring can also incorporate a cover or closure, so that the joined container bodies can be partitioned into multiple compartments. FIG. 33 illustrates a round adapter ring element 216 as described above, a round adapter ring and cover element 240, and a square cover element 242 suitable for used with a square container body. The square cover element can join a larger square container body 252 to a smaller round container body 254, as shown in FIG. 34.

Figure 36:
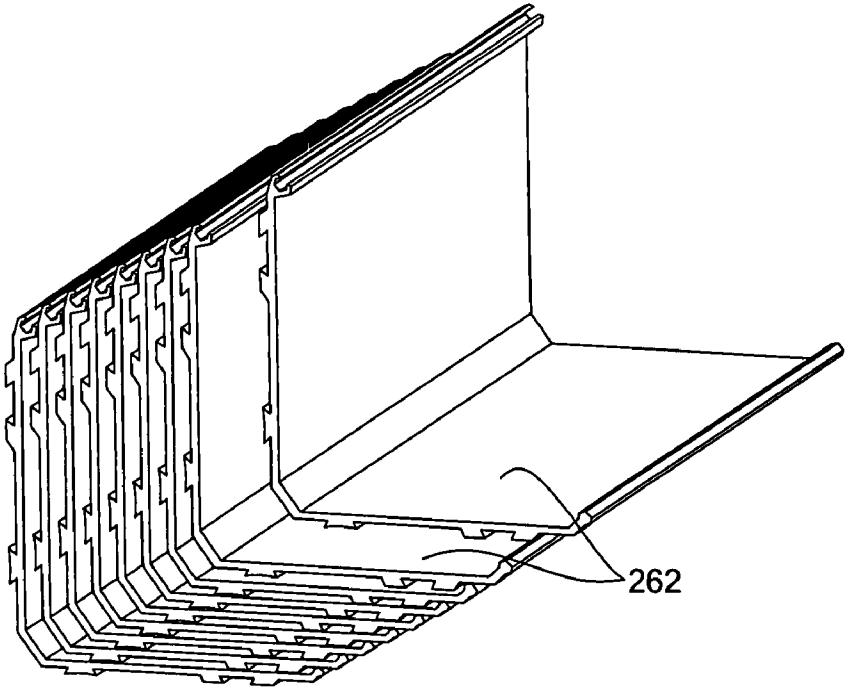
FIG. 36 is an isometric view of the multiple parts of FIG. 35 disassembled and nested.
Figure 35:
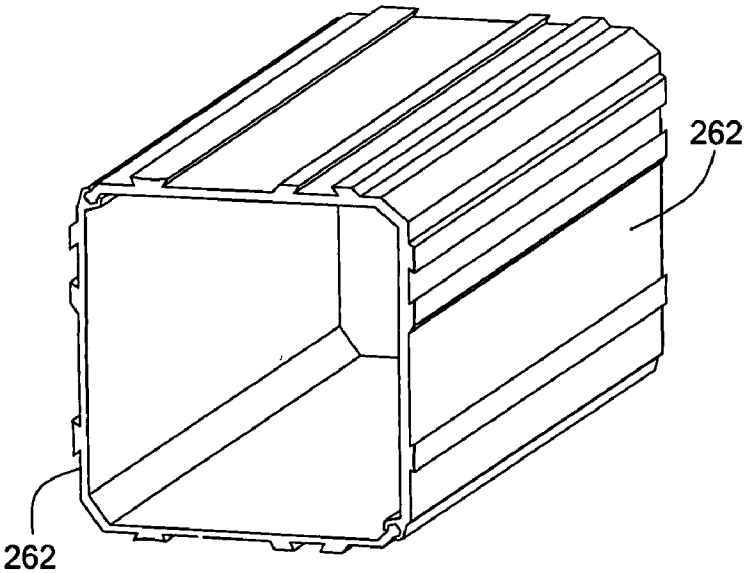
FIG. 35 is an isometric view of a further embodiment of a container body formed of multiple parts.
Figure 37:
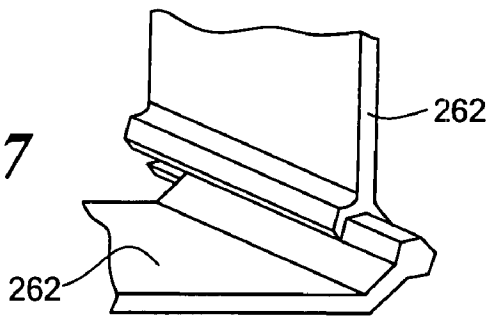
FIG. 37 is an isometric partial view of two parts being joined to form a container body.

The container bodies can also be provided in multiple parts 262 that can be slid together, as illustrated in FIGS. 35-37. Such parts can be readily manufactured by a pultrusion process, as described above. The parts can be disassembled quickly and nested for efficient storage or shipping when not needed for shipping items. The parts can be subsequently reassembled quickly into different container structures.

The packaging system of the present invention provides a low-cost, lightweight, easily disposable, and impact resilient system. The packaging system improves palletization, the loading onto pallets, and minimizes or eliminates the need for banding to hold the containers together on the pallet.

The packaging system of the present invention can be provided as a group of standardized modules in a desired range of sizes, such as small, medium and large. Package volume variation can be made incremental and based on multiples of a minimum container size. Loaded containers can be sized for handling by one person or by two persons. No special tools are required to assemble or disassemble the containers.

The packaging system is suitable for handling both solid contents and liquid contents, such as water. Bladder or bagging systems with self-contained extraction and quick-release coupling mechanisms can be employed without the assistance of pumps to extract liquid contents from the containers, if desired.

The packaging system can be made of biodegradable materials, for example, if superfluous packaging components must be left behind. Structural and packing materials such as fire resistant foams can be employed. The packaging system can provide a level of thermal stability, and can incorporate insulating and conductive properties.

The packaging system can be made to withstand high mechanical impact and pressure loading and excessive thermal loading. For military applications, the modules can withstand impacts from rough handling or bullet and fragment impact.

The invention is not to be limited by what has been particularly shown and described, except as indicated by the appended claims.

What is claimed is:

1. A packaging system comprising:

a generally tubular, hollow container body formed of a fiber-reinforced composite material comprising a container wall extending axially from a first end to a second end, the container body comprising a constant cross-section along its axial length, the container body further comprising cooperative interlocking elements extending axially along an outer surface of the container wall for interlocking with mating cooperative interlocking elements on an adjacent container body; and a closure member configured to close one of the first end and the second end of the container body, wherein the closure member includes a latching mechanism cooperative with a mating element, the mating element disposed on the interlocking elements of the container body.

2. The system of claim 1, wherein the interlocking members comprise a dovetail configuration.

3. The system of claim 1, wherein the interlocking members comprises a mortise member and a tenon member.

4. The system of claim 1, wherein the container body has a generally square cross-section.

5. The system of claim 1, wherein the container body has a generally round cross-section.

6. The system of claim 1, wherein the container body comprises circular sleeves integral within an outer box.

7. The system of claim 1, wherein the interlocking features are arranged diametrically opposite on the container body to connect the container body with mating container bodies in a stack of horizontally and vertically arranged container bodies.

8. The system of claim 1, wherein the mating element on the container body does not penetrate the container wall.

9. The system of claim 1, wherein the latching element comprises a cam mechanism on the closure member and a cam follower on the container body.

10. The system of claim 9, wherein the cam mechanism comprises a cam track and the mating element comprises a ball-headed pin extending from the container body to travel in the cam track.

11. A packaging system comprising:

a generally tubular, hollow container body formed of a fiber-reinforced composite material comprising a container wall extending axially from a first end to a second end;

a closure member configured to close one of the first end and the second end of the container body;

an interface between the closure member and the container body; and an intermediate interface attached to the container body and another container body wherein the interfaces are separately formed annular elements attached to the container body and protecting the edges of the fiber reinforced composite material.

12. The system of claim 11, wherein the intermediate interface is attached with a cam tightening mechanism.

* * * * *